US010191434B2

(12) United States Patent
Zhu

(10) Patent No.: US 10,191,434 B2
(45) Date of Patent: Jan. 29, 2019

(54) IMAGE FORMATION SYSTEM AND CONTROL PROGRAM

(71) Applicant: Konica Minolta, Inc., Chiyoda-ku, Tokyo (JP)

(72) Inventor: Dan Zhu, Koganei (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 174 days.

(21) Appl. No.: 15/482,059

(22) Filed: Apr. 7, 2017

(65) Prior Publication Data

US 2017/0308024 A1 Oct. 26, 2017

(30) Foreign Application Priority Data

Apr. 25, 2016 (JP) ..... 2016-087179

(51) Int. Cl.
*G03G 15/00* (2006.01)

(52) U.S. Cl.
CPC ..... *G03G 15/70* (2013.01); *G03G 15/655* (2013.01); *G03G 15/6552* (2013.01)

(58) Field of Classification Search
CPC ..... G03G 15/70
USPC ..... 311/21
See application file for complete search history.

(56) References Cited

U.S. PATENT DOCUMENTS 5,489,969 A * 2/1996 Soler ..... G03G 15/655 270/58.02
5,596,389 A * 1/1997 Dumas ..... G03G 15/655 399/16
5,761,567 A * 6/1998 Yoshizuka ..... G03G 15/5012 271/3.13
2008/0187249 A1* 8/2008 Konishi ..... G06K 9/2054 382/306
2008/0273884 A1* 11/2008 Yokobori ..... G03G 15/5012 399/21

(Continued)

FOREIGN PATENT DOCUMENTS

CN 101184137 5/2008
CN 104003240 8/2014
JP 60-248557 A 12/1985

OTHER PUBLICATIONS

Office Action issued in corresponding Chinese Patent Application No. 201710260366.6, dated Sep. 29, 2018 (19 pages).

*Primary Examiner* — Anthony Nguyen
(74) *Attorney, Agent, or Firm* — Buchanan Ingersoll & Rooney PC

(57) ABSTRACT

Provided is an image formation system including an image formation device and a post-processing device configured to convey a paper sheet on which an image has been formed at the image formation device or carry out post-processing thereon, including: a paper ejection tray on which the discharged paper sheet is placed; a jam detector configured to detect a jam of the paper sheet conveyed in a paper conveyance passage; a partition paper sheet inserter configured to insert a partition paper sheet on the paper ejection tray; and a control unit, wherein the control unit controls the partition paper sheet inserter such that, after the jam is detected and paper sheets to be removed, at least including a responsible paper sheet, are removed, the partition paper sheet is inserted on the paper ejection tray before the paper sheet remaining in the paper conveyance passage is discharged to the paper ejection tray.

18 Claims, 11 Drawing Sheets

(56) References Cited

U.S. PATENT DOCUMENTS

| | | | | |
|---|---|---|---|---|
| 2011/0135326 | A1* | 6/2011 | Anno | G03G 15/6508 399/21 |
| 2014/0139857 | A1* | 5/2014 | Maeda | H04N 1/0032 358/1.12 |
| 2014/0241737 | A1* | 8/2014 | Shirasaka | G03G 15/6552 399/20 |

* cited by examiner

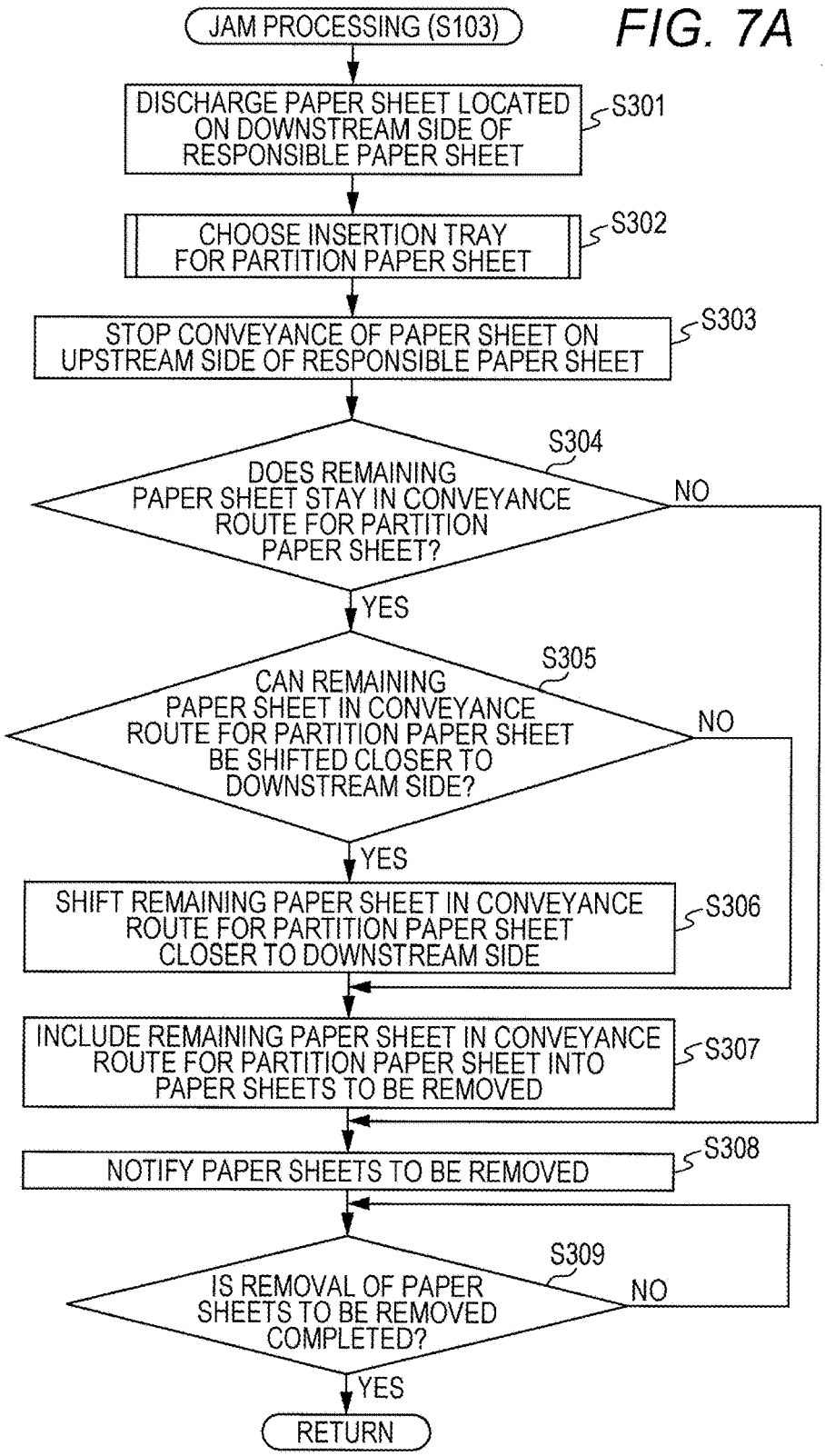
JAM PROCESSING (S103)
FIG. 7A
DISCHARGE PAPER SHEET LOCATED ON DOWNSTREAM SIDE OF RESPONSIBLE PAPER SHEET
S301
CHOOSE INSERTION TRAY FOR PARTITION PAPER SHEET
S302
STOP CONVEYANCE OF PAPER SHEET ON UPSTREAM SIDE OF RESPONSIBLE PAPER SHEET
S303
S304
DOES REMAINING PAPER SHEET STAY IN CONVEYANCE ROUTE FOR PARTITION PAPER SHEET?
NO
YES
S305
CAN REMAINING PAPER SHEET IN CONVEYANCE ROUTE FOR PARTITION PAPER SHEET BE SHIFTED CLOSER TO DOWNSTREAM SIDE?
NO
YES
SHIFT REMAINING PAPER SHEET IN CONVEYANCE ROUTE FOR PARTITION PAPER SHEET CLOSER TO DOWNSTREAM SIDE
S306
INCLUDE REMAINING PAPER SHEET IN CONVEYANCE ROUTE FOR PARTITION PAPER SHEET INTO PAPER SHEETS TO BE REMOVED
S307
NOTIFY PAPER SHEETS TO BE REMOVED
S308
S309
IS REMOVAL OF PAPER SHEETS TO BE REMOVED COMPLETED?
NO
YES
RETURN

100

IMAGE FORMATION SYSTEM AND CONTROL PROGRAM

The entire disclosure of Japanese Patent Application No. 2016-087179 filed on Apr. 25, 2016 including description, claims, drawings, and abstract are incorporated herein by reference in its entirety.

BACKGROUND OF THE INVENTION

Field of the Invention

The present invention relates to an image formation system and a control program.

Description of the Related Art

An image formation system including an image formation device and a post-processing device configured to carry out punching processing, stapling processing, reverse processing and the like, on a paper sheet on which an image is formed by this image formation device has been generally known.

When the occurrence of a paper jam is detected in a paper conveyance passage in such an image formation system, the image formation system temporarily suspends print processing being carried out to start jam processing which is processing for resuming normal paper conveyance carried out before the paper jam occurred.

In the jam processing, the image formation system discharges, as a usable paper sheet, a paper sheet that was being conveyed in the paper conveyance passage situated downstream of a paper sheet that has caused the paper jam (hereinafter, referred to as "responsible paper sheet") in a paper conveyance direction as it is. Meanwhile, the image formation system moves a paper sheet that was being conveyed in the paper conveyance passage situated upstream of the responsible paper sheet in the paper conveyance direction to a position available for purging, thereafter to stop there.

Subsequently, the image formation system, for example, displays a position of the responsible paper sheet on a display to prompt a user to remove the responsible paper sheet from the paper conveyance passage. It is difficult to mechanically remove the responsible paper sheet in most cases and thus, the user is required to remove. After the above responsible paper sheet is removed by the user and the jam processing is completed, the image formation system again conveys the paper sheet stopped at the aforementioned position available for purging to discharge the paper sheet to the outside (called "automatic purge"). The paper sheet discharged through the automatic purge is treated as a paper sheet not to be reused, namely, an unusable paper sheet.

In a case where the image formation system includes a plurality of paper ejection trays, by causing the usable paper sheet and the unusable paper sheet to be discharged to different paper ejection trays, the unusable paper sheet discharged after the jam processing and the usable paper sheet discharged before the jam processing do not overlap and accordingly, the user can distinguish both of the paper sheets from each other with ease.

However, in a case where the image formation system includes only one paper ejection tray, or a case where the usable paper sheet and the unusable paper sheet are only allowed to be discharged to one particular paper ejection tray even though the image formation system includes the plurality of paper ejection trays, the usable paper sheet and the unusable paper sheet are supposed to be discharged to one and the same paper ejection tray. Accordingly, the unusable paper sheet discharged after the jam processing and the usable paper sheet discharged before the jam processing overlap, causing a risk where the user can no longer distinguish both of the paper sheets from each other.

In association with this, JP 60-248557 A discloses an image recording device an object of which is to achieve easy sorting between the usable paper sheet and the unusable paper sheet on the paper ejection tray in such a manner that the position of the unusable paper sheet is shifted relative to the usable paper sheet on the paper ejection tray when discharged during the automatic purge.

However, in a case where different paper sizes are mixed in one print job, discharging the unusable paper sheet by shifting the position thereof relative to the usable paper sheet causes a problem in that the user has difficulties to distinguish at a glance a case where the paper sheet is discharged to a shifted position from a case where a paper sheet in a different size is discharged.

SUMMARY OF THE INVENTION

The present invention has been made by taking the above problem into account. Therefore, an object of the invention is to provide an image formation system and a control program that allow a user to distinguish a usable paper sheet and an unusable paper sheet from each other with ease when the usable paper sheet discharged before jam processing and the unusable paper sheet discharged after the jam processing are discharged to one and the same paper ejection tray.

The aforementioned object of the invention is achieved through a manner described below.

(1) To achieve the abovementioned object, according to an aspect, an image formation system including an image formation device and a post-processing device configured to either convey a paper sheet on which an image has been formed at the image formation device or carry out post-processing thereon, reflecting one aspect of the present invention comprises: a paper ejection tray on which the discharged paper sheet is placed; a jam detector configured to detect a jam of the paper sheet conveyed in a paper conveyance passage; a partition paper sheet inserter configured to insert a partition paper sheet on the paper ejection tray by way of the paper conveyance passage; and a control unit, wherein the control unit controls the partition paper sheet inserter such that, after the jam is detected by the jam detector and paper sheets to be removed, at least including a responsible paper sheet acting as a cause of the jam, are removed, the partition paper sheet is inserted on the paper ejection tray before the paper sheet remaining in the paper conveyance passage is conveyed to be discharged to the paper ejection tray.

(2) The image formation system of Item. 1, wherein the paper sheets to be removed preferably include the responsible paper sheet and a paper sheet remaining in a conveyance route for the partition paper sheet extending from the partition paper sheet inserter to the paper ejection tray, which paper sheet is positioned upstream of the responsible paper sheet in a paper conveyance direction.

(3) The image formation system of Item. 1 or 2, wherein in a case where the jam is detected by the jam detector and there is a paper sheet remaining in a conveyance route for the partition paper sheet extending from the partition paper sheet inserter to the paper ejection tray, which paper sheet is positioned upstream of the responsible paper sheet in a paper conveyance direction, the control unit preferably makes a notification to a user to prompt the removal of this paper sheet by regarding this paper sheet as the paper sheet to be removed.

(4) The image formation system of Item. 1, preferably further comprising a display unit, wherein the control unit preferably, after the jam is detected by the jam detector, locates a paper sheet remaining in a conveyance route for the partition paper sheet extending from the partition paper sheet inserter to the paper ejection tray, which paper sheet is positioned upstream of the responsible paper sheet in a paper conveyance direction, and displays, on the display unit, this paper sheet and the responsible paper sheet as the paper sheets to be removed, and controls the partition paper sheet inserter such that the partition paper sheet is inserted on the paper ejection tray after the paper sheets to be removed are removed.

(5) The image formation system of any one of Items. 1 to 4, preferably further comprising a plurality of paper inserters as the partition paper sheet inserters, each of which is capable of supplying the partition paper sheet, wherein the control unit preferably controls such that the partition paper sheet is inserted on the paper ejection tray from the paper inserter positioned immediately upstream from the paper ejection tray in a paper conveyance direction among the plurality of paper inserters, by way of the paper conveyance passage.

(6) The image formation system of any one of Items. 1 to 4, preferably further comprising at least one paper inserter as the partition paper sheet inserter, which is capable of supplying the partition paper sheet, wherein the control unit preferably controls such that the partition paper sheet is inserted on the paper ejection tray from the paper inserter set in advance, by way of the paper conveyance passage.

(7) The image formation system of any one of Items. 1 to 4, preferably further comprising a plurality of paper inserters as the partition paper sheet inserters, each of which is capable of supplying the partition paper sheet, wherein the control unit preferably chooses the paper inserter to be used, on the basis of at least one of paper information on the paper sheet ejected to the paper ejection tray and paper information on the paper sheet remaining in the paper conveyance passage, as well as paper information on the paper sheets set in the plurality of paper inserters, and controls such that the partition paper sheet is inserted on the paper ejection tray from the chosen paper inserter by way of the paper conveyance passage.

(8) The image formation system of anyone of Items. 1 to 7, preferably further comprising the plurality of post-processing devices, wherein after the jam is detected by the jam detector, the control unit preferably locates a paper sheet remaining in a conveyance route for the partition paper sheet extending from the partition paper sheet inserter to the paper ejection tray, which paper sheet is positioned upstream of the responsible paper sheet in a paper conveyance direction, and shifts the paper sheet to the paper conveyance passage in the post-processing device arranged upstream of a position of the responsible paper sheet but on a downstream side of a position of the paper sheet, to stop there.

(9) The image formation system of anyone of Items. 1 to 8, wherein after the jam is detected by the jam detector, the control unit preferably moves a paper sheet being conveyed in the paper conveyance passage situated upstream of the paper sheet to be removed in a paper conveyance direction to a predetermined escape position available for purging, thereafter to stop there.

(10) To achieve the abovementioned object, according to an aspect, there is provided a non-transitory recording medium storing a computer readable control program for an image formation system including an image formation device and a post-processing device configured to either convey a paper sheet on which an image has been formed at the image formation device or carry out post-processing thereon, and the control program reflecting one aspect of the present invention causes a computer to execute: a procedure of discharging the paper sheet on which an image has been formed at the image formation device to a paper ejection tray installed at the post-processing device; a procedure of detecting a jam of the paper sheet in a paper conveyance passage in the image formation system; a procedure of, after paper sheets to be removed, at least including a responsible paper sheet acting as a cause of the jam, are removed, inserting a partition paper sheet on the paper ejection tray by way of the paper conveyance passage before a paper sheet remaining in the paper conveyance passage is conveyed to be discharged to the paper ejection tray; and a procedure of discharging the remaining paper sheet in the paper conveyance passage to the paper ejection tray.

(11) The non-transitory recording medium storing a computer readable control program of Item. 10, wherein the paper sheets to be removed preferably include the responsible paper sheet and a paper sheet remaining in a conveyance route for the partition paper sheet extending from a position where the partition paper sheet is inserted into the paper conveyance passage to the paper ejection tray, which paper sheet is positioned upstream of the responsible paper sheet in a paper conveyance direction.

(12) The non-transitory recording medium storing a computer readable control program of Item. 10, wherein in the procedure of carrying out jam processing, in a case where there is the responsible paper sheet acting as a cause of the jam and a paper sheet remaining in a conveyance route for the partition paper sheet, which paper sheet is positioned upstream of the responsible paper sheet in a paper conveyance direction, a notification is preferably made to a user to prompt the removal of these paper sheets by regarding these paper sheets as the paper sheets to be removed.

(13) The non-transitory recording medium storing a computer readable control program of Item. 10, the control program for preferably causing the computer to execute: a procedure of, after the jam is detected, locating a paper sheet remaining in a conveyance route for the partition paper sheet extending from a position where the partition paper sheet is inserted into the paper conveyance passage to the paper ejection tray, which paper sheet is positioned upstream of the responsible paper sheet in a paper conveyance direction, and displaying, on a display unit, this paper sheet and the responsible paper sheet as the paper sheets to be removed; and a procedure of, after the paper sheets to be removed are removed, inserting the partition paper sheet on the paper ejection tray.

(14) The non-transitory recording medium storing a computer readable control program of Item. 10, wherein the image formation system preferably further comprises a plurality of paper inserters each capable of supplying the partition paper sheet, and the control program preferably causes the computer to execute a procedure of inserting the partition paper sheet on the paper ejection tray from the paper inserter positioned immediately upstream from the paper ejection tray in a paper conveyance direction among the plurality of paper inserters, by way of the paper conveyance passage.

(15) The non-transitory recording medium storing a computer readable control program of Item. 10, wherein the image formation system preferably further comprises at least one paper inserter capable of supplying the partition paper sheet, and the control program preferably causes the computer to execute a procedure of inserting the partition paper sheet on the paper ejection tray from the paper inserter set in advance, by way of the paper conveyance passage.

(16) The non-transitory recording medium storing a computer readable control program of Item. 10, wherein the image formation system preferably further comprises a plurality of paper inserters each capable of supplying the partition paper sheet, and the control program preferably causes the computer to execute a procedure of choosing the paper inserter to be used, on the basis of at least one of paper information on the paper sheet ejected to the paper ejection tray and paper information on the paper sheet remaining in the paper conveyance passage, as well as paper information on the paper sheets set in the plurality of paper inserters, and inserting the partition paper sheet on the paper ejection tray from the chosen paper inserter by way of the paper conveyance passage.

(17) The non-transitory recording medium storing a computer readable control program of Item. 10, wherein the image formation system preferably further comprises the plurality of post-processing devices, and the control program preferably causes the computer to execute a procedure of, after the jam is detected, locating a paper sheet remaining in a conveyance route for the partition paper sheet extending from a position where the partition paper sheet is inserted into the paper conveyance passage to the paper ejection tray, which paper sheet is positioned upstream of the responsible paper sheet in a paper conveyance direction, and shifting the paper sheet to the paper conveyance passage in the post-processing device arranged upstream of a position of the responsible paper sheet but on a downstream side of a position of the paper sheet, to stop there.

(18) The non-transitory recording medium storing a computer readable control program of Item. 10, wherein the control program preferably causes the computer to execute a procedure of, after the jam is detected, moving a paper sheet being conveyed in the paper conveyance passage situated upstream of the paper sheet to be removed in a paper conveyance direction to a predetermined escape position available for purging, thereafter to stop there.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 7A is a subroutine flowchart exemplifying "jam processing" according to the second embodiment of the invention;

DESCRIPTION OF THE PREFERRED EMBODIMENTS

Figure 1:
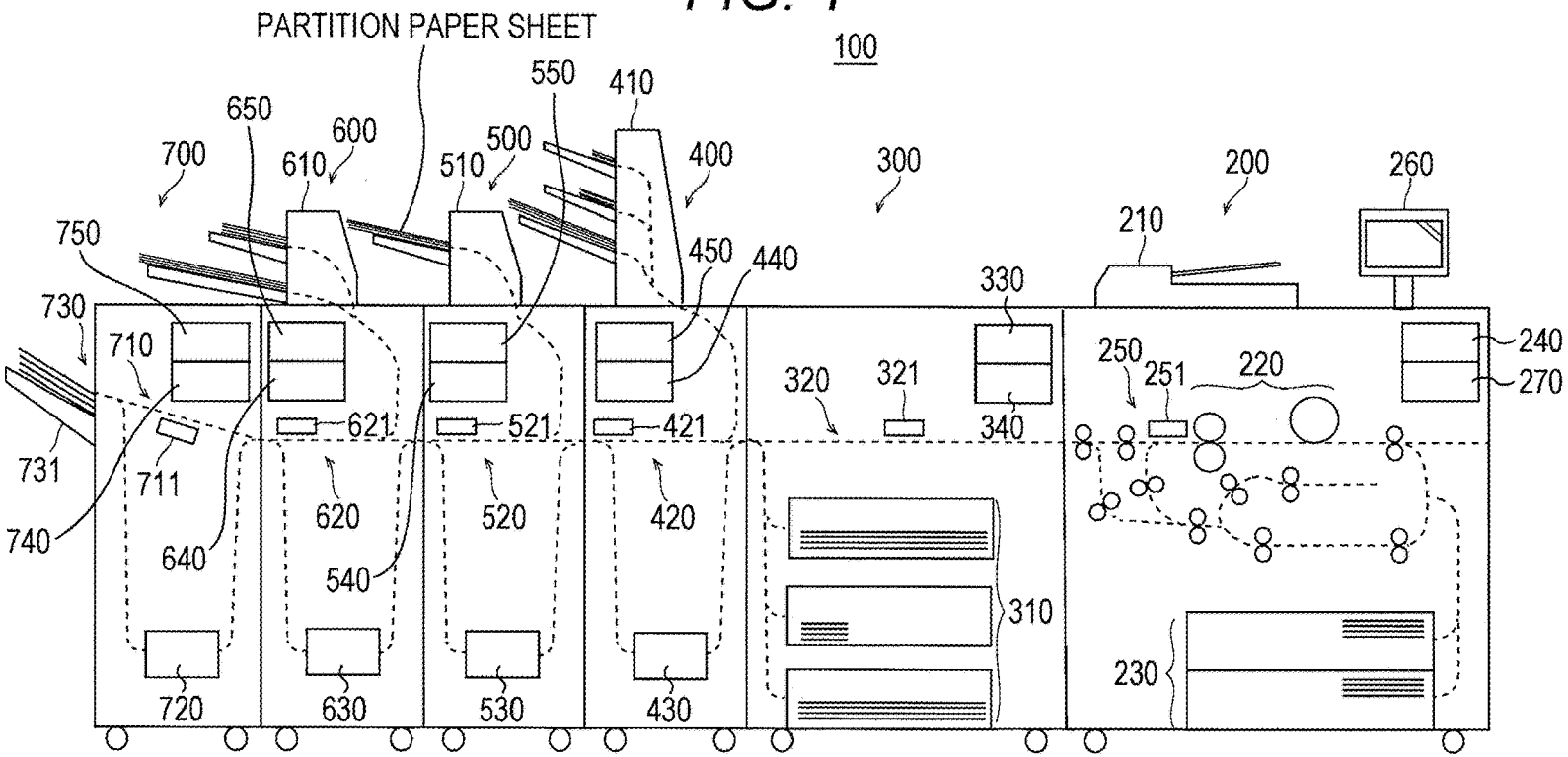
FIG. 1 is a schematic cross-sectional view exemplifying a configuration of an image formation system according to a first embodiment of the invention.

Hereinafter, embodiments of an image formation system and a control program according to the present invention will be described with reference to the drawings. However, the scope of the invention is not limited to the illustrated examples. Note that the same reference numerals are used for the same members in the drawings. In addition, dimensional ratios in the drawings are exaggerated for convenience of description and, in some cases, differ from the actual ratios. In the present description, being upstream and downstream with respect to a paper conveyance direction in a paper conveyance passage within the image formation system is sometimes mentioned simply as being "upstream" and "downstream", respectively.

First Embodiment

<Image Formation System 100>

Figure 2:
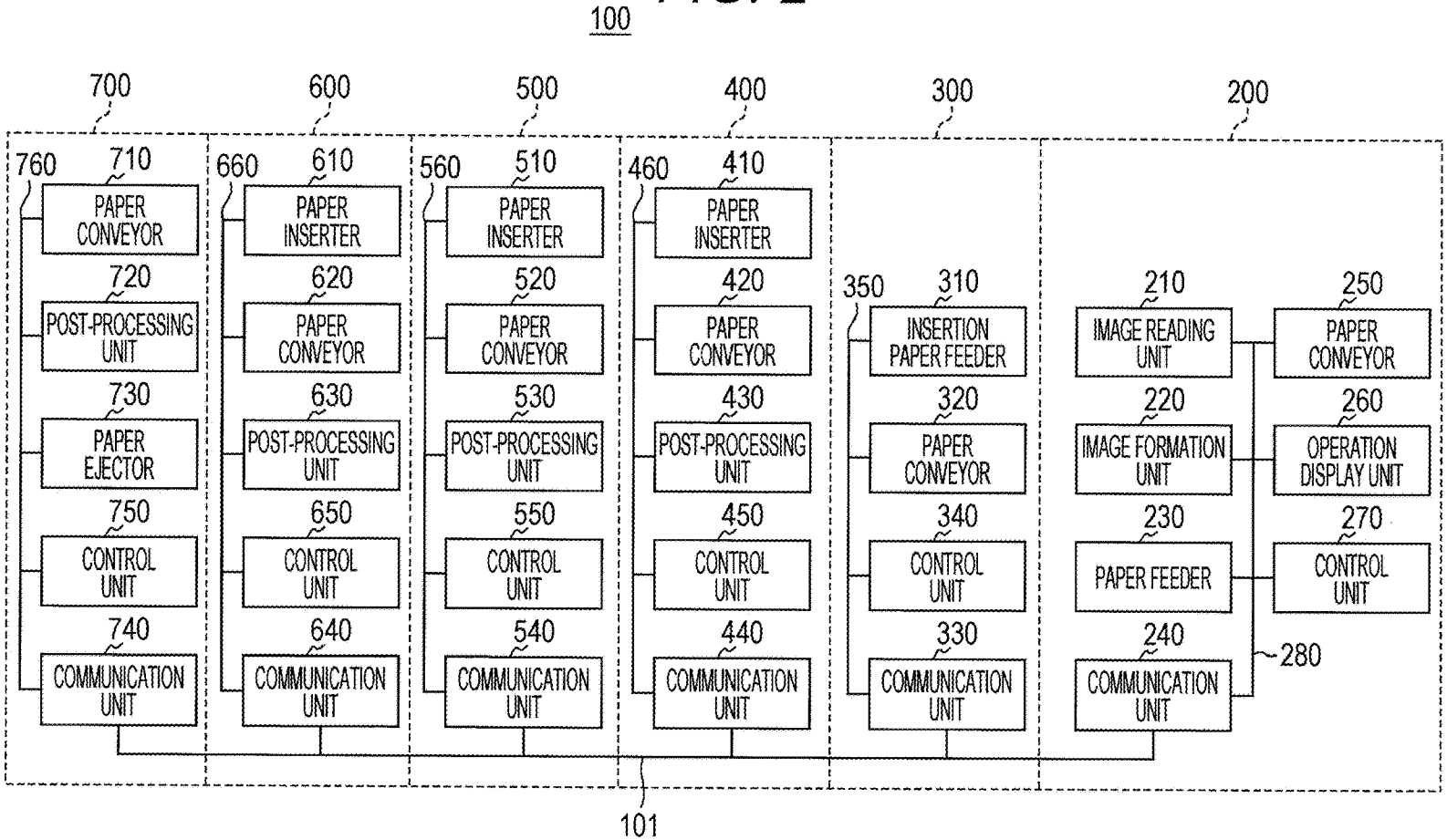
FIG. 2 is a schematic block diagram exemplifying a hardware configuration of the image formation system illustrated in FIG. 1.

FIG. 1 is a schematic cross-sectional view exemplifying a configuration of an image formation system according to a first embodiment, whereas FIG. 2 is a schematic block diagram exemplifying a hardware configuration of the image formation system illustrated in FIG. 1.

As illustrated in FIGS. 1 and 2, the image formation system 100 according to the embodiment has an image formation device 200, an insertion paper feeding device 300, a first post-processing device 400, a second post-processing device 500, a third post-processing device 600, and a fourth post-processing device 700. Note that the configuration of the image formation system 100 illustrated in FIG. 1 serves as an example and the type and the number of devices included in the image formation system 100 are not limited to the example illustrated in FIG. 1.

<Image Formation Device 200>

The image formation device 200 has an image reading unit 210, an image formation unit 220, a paper feeder 230, a communication unit 240, a paper conveyor 250, an operation display unit 260, and a control unit 270. These constituent elements are interconnected through an internal bus 280.

The image reading unit 210 includes an optical system constituted by a mirror, a lens and so on and a reading sensor. The image reading unit 210 reads a document placed on a reading surface or a document conveyed by an auto document feeder (ADF) to output an image signal.

By using a commonly known image generation process such as an electrophotographic process including respective processes made up of electrification, exposure, development, transfer, and fixing, the image formation unit 220 forms an image on a paper sheet on the basis of a print job received from, for example, a client terminal or the aforementioned image signal.

The paper feeder 230 supplies the paper sheet serving as a recording material used in printing. The paper feeder 230 has a plurality of paper trays and, for example, A4 size white paper sheets are contained in each of the paper trays.

The communication unit 240 is connected to the client terminal such as a personal computer via a network to transmit and receive the print job and other data thereto and therefrom. The network is constituted by various types of networks, including a local area network (LAN), a wide area network (WAN) interconnecting the LANs through a dedicated line, the Internet, and a combination thereof. Examples of LAN standard include Ethernet (registered trademark), token ring, and fiber-distributed data interface (FDDI). Examples of communication protocol include transmission control protocol/Internet protocol (TCP/IP).

The communication unit 240 is also connected to another device in the image formation system 100 through a communication line 101 provided between devices so as to be able to communicate with each other, thereby transmitting and receiving data thereto and therefrom.

The paper conveyor 250 conveys the paper sheet within the image formation device 200. The paper conveyor 250 has the paper conveyance passage and a paper detection sensor 251 installed at a predetermined position in this paper conveyance passage. Note that, although the plurality of paper detection sensors 251 is arranged such that the conveyance of the paper sheet can be sensed at a plurality of positions such as a position immediately before a branching point in the paper conveyance passage, FIG. 1 solely illustrates one paper detection sensor 251 as a representative (the same applies to other paper detection sensors).

The paper sheet supplied from the paper feeder 230 is conveyed to the image formation unit 220 by way of the paper conveyance passage. In the image formation unit 220, the paper sheet on which the image has been formed is discharged to the outside of the image formation device 200 by way of a paper ejector (not illustrated) and then supplied to the insertion paper feeding device 300.

Meanwhile, the paper detection sensor 251 functions as a jam detector and detects the paper jam in the paper conveyance passage.

The operation display unit 260 has, for example, a display (display unit) and a keyboard or a touch panel to function as an input unit and an output unit. The keyboard has a plurality of keys, including a selection key for specifying the size of the paper sheet, a ten-key for setting the number of copies and so on, a start key for instructing a start of an action, and a stop key for instructing a stop of an action. The input unit is used by a user when giving various instructions (input) such as character input, various settings, and a start instruction. Meanwhile, the output unit is used to present, to the user, an apparatus configuration, a status of the implementation of the print job, a status of the occurrence of the paper jam, a status of the occurrence of an error, a setting currently changeable, and so on.

The control unit 270 controls the image reading unit 210, the image formation unit 220, the paper feeder 230, the communication unit 240, the paper conveyor 250, and the operation display unit 260. The control unit 270 has an auxiliary storage device, a memory, and a central processing unit (CPU) (not illustrated). These respective constituent elements are interconnected via a bus so as to be able to communicate with one another. The control unit 270 plays a role as a print controller.

The auxiliary storage device includes a mass storage device such as a hard disk drive and a flash memory. The memory includes a random access memory (RAM) and a read only memory (ROM). A calculation result derived from execution by the CPU, jam occurrence information and so on are saved to the RAM to be kept therein. The jam occurrence information is information regarding the paper jam detected within the image formation system 100.

The CPU executes a control program for the image formation device in the control unit 270. The control program for the image formation device is stored in the auxiliary storage device and loaded into the RAM of the memory when executed by the CPU. The CPU controls the image reading unit 210, the image formation unit 220, the paper feeder 230, the communication unit 240, the paper conveyor 250, and the operation display unit 260 in accordance with the aforementioned control program.

<Insertion Paper Feeding Device 300>

The insertion paper feeding device 300 supplies the paper sheet to the first post-processing device 400 in accordance with an instruction from the image formation device 200. The insertion paper feeding device 300 arranged between the image formation device 200 and the first post-processing device 400 has an insertion paper feeder 310, a paper conveyor 320, a communication unit 330, and a control unit 340. These constituent elements are interconnected through an internal bus 350.

The insertion paper feeder 310 has a plurality of paper feed trays and is capable of holding a large amount of paper sheets of different types of sizes, colors, thicknesses, basis weights and so on. In the embodiment, the insertion paper feeder 310 includes, for example, three paper feed trays and the paper sheets having different sizes are individually housed in these three paper feed trays.

The paper conveyor 320 includes a paper introduction unit, a paper discharge unit, and a paper conveyance passage (not illustrated) as well as a paper detection sensor 321 installed at a predetermined position in this paper conveyance passage. The paper conveyor 320 introduces, from the paper introduction unit, the paper sheet on which the image has been formed by the image formation device 200 to convey to the paper discharge unit along the paper conveyance passage. The paper discharge unit discharges the paper sheet to the first post-processing device 400. The paper conveyor 320 also conveys the paper sheet from the insertion paper feeder 310 along the paper conveyance passage to discharge the paper sheet to the first post-processing device 400 from the paper discharge unit. Meanwhile, the paper detection sensor 321 functions as a jam detector and detects the paper jam in the paper conveyance passage.

The communication unit 330 is connected to another device in the image formation system 100 through the communication line 101 provided between devices so as to be able to communicate with each other, thereby transmitting and receiving data thereto and therefrom.

The control unit 340 has an auxiliary storage device, a memory, and a CPU (not illustrated). These respective constituent elements are interconnected via a bus so as to be able to communicate with one another. The auxiliary storage device includes a mass storage device such as a hard disk drive and a flash memory and keeps a control program for the insertion paper feeding device saved therein. The memory includes a RAM and a ROM. The CPU executes the control program for the insertion paper feeding device in the control unit 340 to control the insertion paper feeder 310, the paper conveyor 320, and the communication unit 330.

<First Post-Processing Device 400>

The first post-processing device 400 conveys the paper sheet supplied from the insertion paper feeding device 300 or carries out post-processing thereon in accordance with the instruction from the image formation device 200 to supply to the second post-processing device 500. The first post-processing device 400 arranged between the insertion paper feeding device 300 and the second post-processing device 500 has a paper inserter 410, a paper conveyor 420, a post-processing unit 430, a communication unit 440, and a control unit 450. These constituent elements are interconnected through an internal bus 460.

The paper inserter 410 includes a page inserter (PI) unit, where this PI unit has a plurality of insertion trays such that the paper sheets of different types of sizes, colors, thicknesses, basis weights and so on can be placed thereon. In the example illustrated in FIG. 1, a smallest size paper sheet is set in the insertion tray at an upper level, a B5 size paper sheet is set in the insertion tray at a middle level, and an A3 size paper sheet is set in the insertion tray at a lower level in the paper inserter 410. In addition, paper information such as the sizes of the paper sheets set in the respective insertion trays, the types of the paper sheets (colors of the paper sheets) and so on is saved in the auxiliary storage device of the control unit 270 as insertion tray information.

The paper conveyor 420 includes a paper introduction unit, a paper discharge unit, and a paper conveyance passage (not illustrated) as well as a paper detection sensor 421 installed at a predetermined position in this paper conveyance passage. The paper conveyor 420 introduces the paper sheet supplied by the insertion paper feeding device 300 from the paper introduction unit to convey to the paper discharge unit along the paper conveyance passage. The paper discharge unit discharges the paper sheet to the second post-processing device 500. The paper conveyor 420 also conveys the paper sheet introduced from the paper introduction unit to the post-processing unit 430 and then conveys the paper sheet on which the post-processing has been carried out to the paper discharge unit. Additionally, the paper conveyor 420 conveys the paper sheet from the paper inserter 410 along the paper conveyance passage to discharge the paper sheet to the second post-processing device 500 from the paper discharge unit. Meanwhile, the paper detection sensor 421 functions as a jam detector and detects the paper jam in the paper conveyance passage.

The post-processing unit 430 carries out the post-processing on the paper sheet. In the embodiment, examples of the post-processing include punching processing, stapling processing, curl correction processing, and reverse processing.

The communication unit 440 is connected to another device in the image formation system 100 through the communication line 101 provided between devices so as to be able to communicate with each other, thereby transmitting and receiving data thereto and therefrom.

The control unit 450 has an auxiliary storage device, a memory, and a CPU (not illustrated). These respective constituent elements are interconnected via a bus so as to be able to communicate with one another. The auxiliary storage device includes a mass storage device such as a hard disk drive and a flash memory and keeps a control program for the first post-processing device saved therein. The memory includes a RAM and a ROM. The CPU executes the above control program in the control unit 450 to control the paper inserter 410, the paper conveyor 420, the post-processing unit 430, and the communication unit 440.

<Second Post-Processing Device 500>

The second post-processing device 500 conveys the paper sheet supplied from the first post-processing device 400 or carries out the post-processing thereon in accordance with the instruction from the image formation device 200 to supply to the third post-processing device 600. The second post-processing device 500 arranged between the first post-processing device 400 and the third post-processing device 600 has a paper inserter 510, a paper conveyor 520, a post-processing unit 530, a communication unit 540, and a control unit 550. These constituent elements are interconnected through an internal bus 560.

The paper inserter 510 functions as a partition paper sheet inserter and supplies a partition paper sheet to the paper conveyor 520. The paper inserter 510 has an insertion tray dedicated for supplying the partition paper sheet (hereinafter, also mentioned as "dedicated insertion tray"), where this dedicated insertion tray is configured such that the partition paper sheet can be placed thereon. The partition paper sheet is a paper sheet inserted for the purpose of allowing the user to distinguish a usable paper sheet and an unusable paper sheet discharged to a paper ejection tray 731 included in the fourth post-processing device 700 from each other with ease.

In the embodiment, the partition paper sheet is chosen in advance such that a paper sheet of a type different from a type of the paper sheet included in the print job is employed. For example, in a case where the paper sheets in the print job are all specified to A4 size white paper sheets, a paper sheet having a size other than the A4 size can be set in the dedicated insertion tray as the partition paper sheet. Alternatively, the partition paper sheet can be an A4 size color paper sheet or a color paper sheet having a size other than the A4 size. In a case where the paper sheets in the print job are all specified to A4 size, it is preferable for the partition paper sheet to be a paper sheet having a size larger than the A4 size such that it becomes easier for the user to judge. In addition, the paper information on the partition paper sheet set in the dedicated insertion tray is saved in the auxiliary storage device of the control unit 270 as the insertion tray information.

The paper conveyor 520, the post-processing unit 530, and the communication unit 540 have configurations similar to those of the paper conveyor 420, the post-processing unit 430, and the communication unit 440 in the first post-processing device 400, respectively, and the description about the configurations will be thus omitted.

The control unit 550 executes a control program for the second post-processing device to control the paper inserter 510, the paper conveyor 520, the post-processing unit 530, and the communication unit 540. A hardware configuration of the control unit 550 is similar to the hardware configuration of the control unit 450 in the first post-processing device 400 and thus, the description thereof will be omitted.

Note that the second post-processing device 500 can be configured to function exclusively as the paper conveyor and the partition paper sheet inserter by excluding the post-processing unit 530 from the second post-processing device 500.

<Third Post-Processing Device 600>

The third post-processing device 600 conveys the paper sheet supplied from the second post-processing device 500 or carries out the post-processing thereon in accordance with the instruction from the image formation device 200 to supply to the fourth post-processing device 700. The third post-processing device 600 arranged between the second post-processing device 500 and the fourth post-processing device 700 has a paper inserter 610, a paper conveyor 620, a post-processing unit 630, a communication unit 640, and a control unit 650. These constituent elements are interconnected through an internal bus 660.

The paper inserter 610 includes a PI unit, where this PI unit has a plurality of insertion trays such that the paper sheets of different types of sizes, colors, thicknesses, basis weights and so on can be placed thereon. In the example illustrated in FIG. 1, an A4 size paper sheet is set in the insertion tray at an upper level and a B3 size paper sheet is set in the insertion tray at a lower level in the paper inserter 610. In addition, the paper information on the paper sheets set in the respective insertion trays is saved in the auxiliary storage device of the control unit 270 as the insertion tray information.

The paper conveyor 620, the post-processing unit 630, and the communication unit 640 have configurations similar to those of the paper conveyor 420, the post-processing unit 430, and the communication unit 440 in the first post-processing device 400, respectively, and the description about the configurations will be thus omitted.

The control unit 650 executes a control program for the third post-processing device to control the paper inserter 610, the paper conveyor 620, the post-processing unit 630, and the communication unit 640. A hardware configuration of the control unit 650 is similar to the hardware configuration of the control unit 450 in the first post-processing device 400 and thus, the description thereof will be omitted.

<Fourth Post-Processing Device 700>

The fourth post-processing device 700 conveys the paper sheet supplied from the third post-processing device 600 or carries out the post-processing thereon in accordance with the instruction from the image formation device 200 to discharge the paper sheet to the outside of the image formation system 100. The fourth post-processing device 700 positioned at a latter stage of the third post-processing device 600 has a paper conveyor 710, a post-processing unit 720, a paper ejector 730, a communication unit 740, and a control unit 750. These constituent elements are interconnected through an internal bus 760.

The paper conveyor 710, the post-processing unit 720, and the communication unit 740 have configurations similar to those of the paper conveyor 420, the post-processing unit 430, and the communication unit 440 in the first post-processing device 400, respectively, and the description about the configurations will be thus omitted.

The paper ejector 730 discharges the paper sheet to the outside of the image formation system 100. The paper ejector 730 has the paper ejection tray 731 on which the discharged paper sheet is placed. In the embodiment, the paper ejection tray 731 serves as only one paper ejection tray in the image formation system 100 and accordingly, the usable paper sheet discharged before jam processing and the unusable paper sheet discharged through automatic purge after the jam processing are discharged to one and the same paper ejection tray 731. Note that the embodiment also includes a case where, although the plurality of paper ejection trays are provided, the usable paper sheet and the unusable paper sheet discharged through the automatic purge are set to be discharged to one and the same paper ejection tray because another paper ejection tray is not available for use due to such a situation that another discharged paper sheet is placed on the another paper ejection tray.

The control unit 750 executes a control program for the fourth post-processing device to control the paper conveyor 710, the post-processing unit 720, the paper ejector 730, and the communication unit 740. A hardware configuration of the control unit 750 is similar to the hardware configuration of the control unit 450 in the first post-processing device 400 and thus, the description thereof will be omitted.

<Control Method>

Figure 3A:
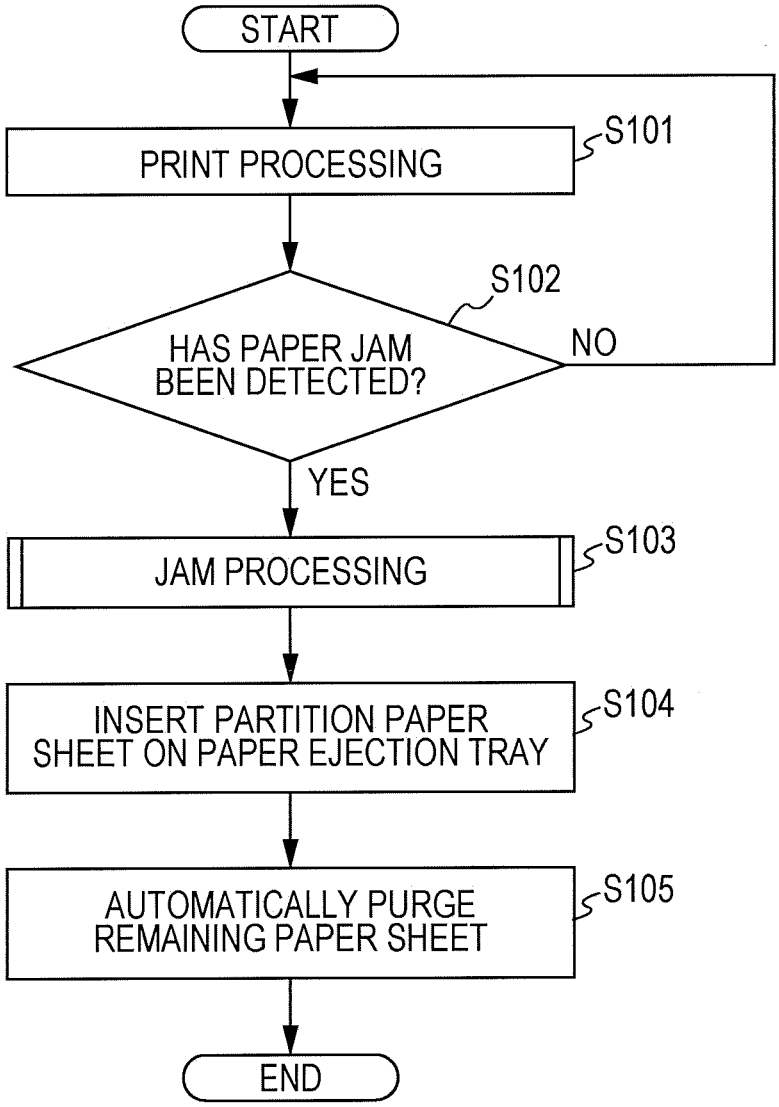
FIG. 3A is a flowchart exemplifying a main routine of a control method according to the first embodiment of the invention.
Figure 3B:
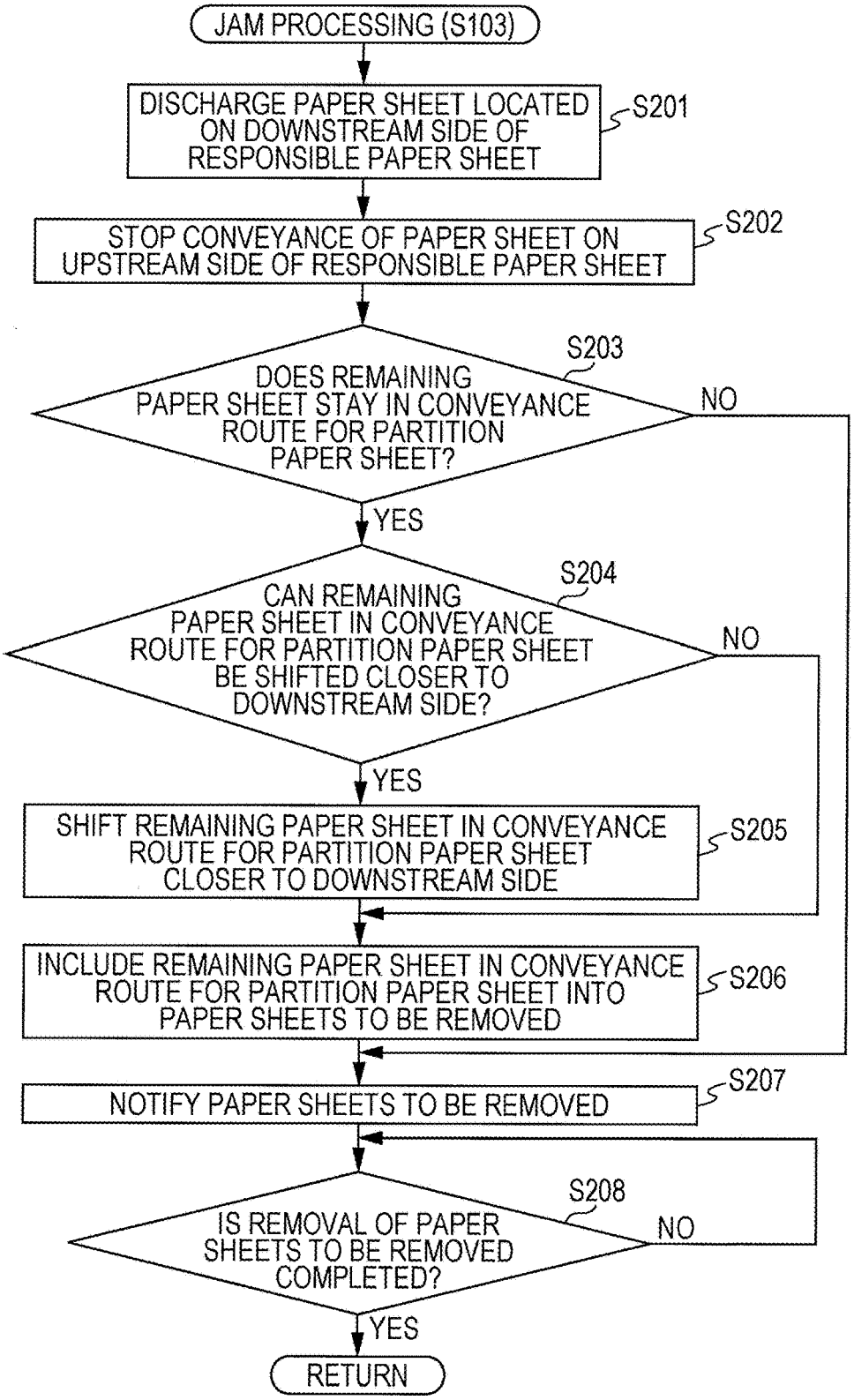
FIG. 3B is a subroutine flowchart exemplifying "jam processing" illustrated in FIG. 3A.
Figure 4:
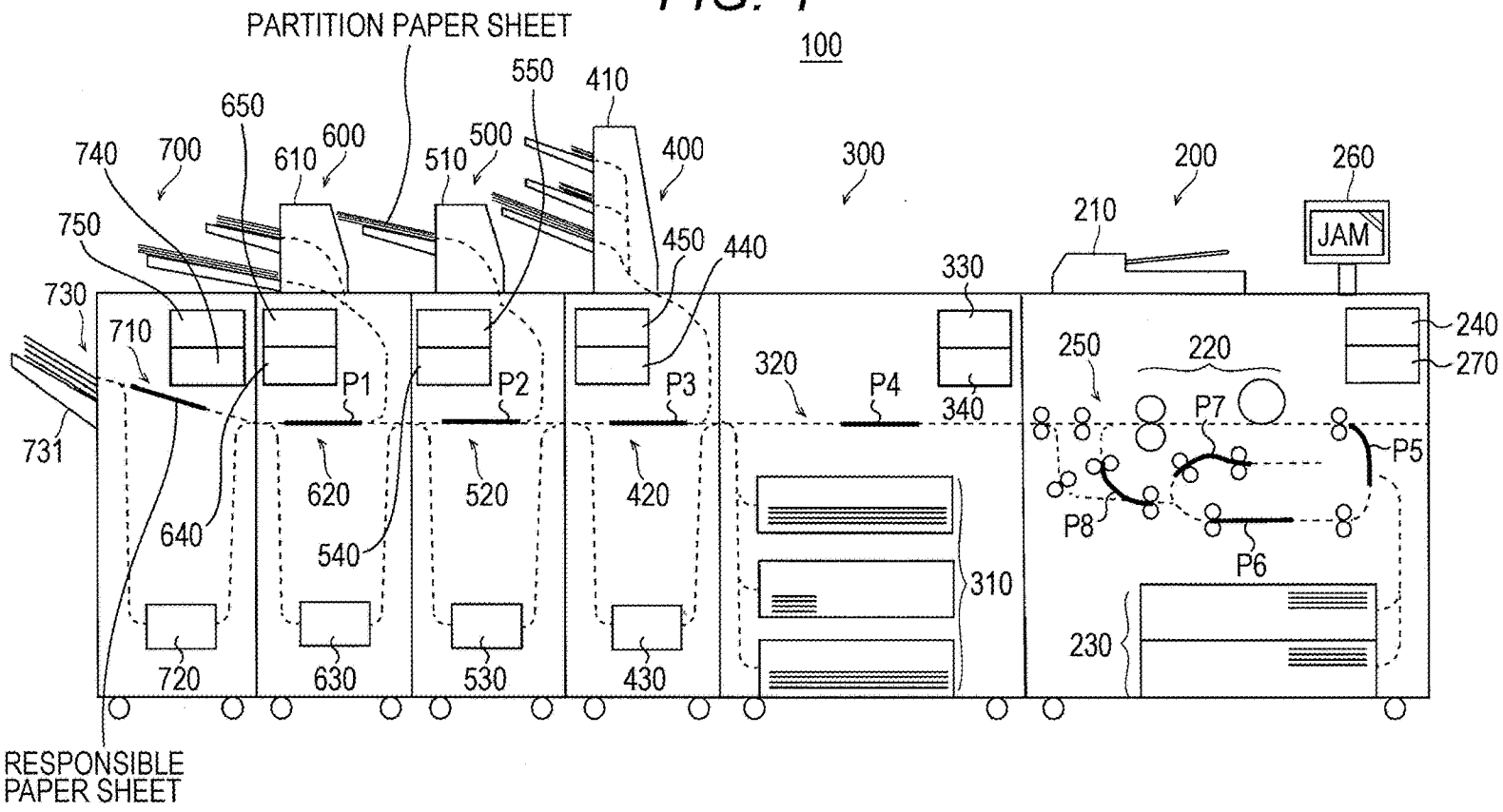
FIG. 4 is a schematic cross-sectional view illustrating an exemplary action of the image formation system according to the first embodiment of the invention.
Figure 5:
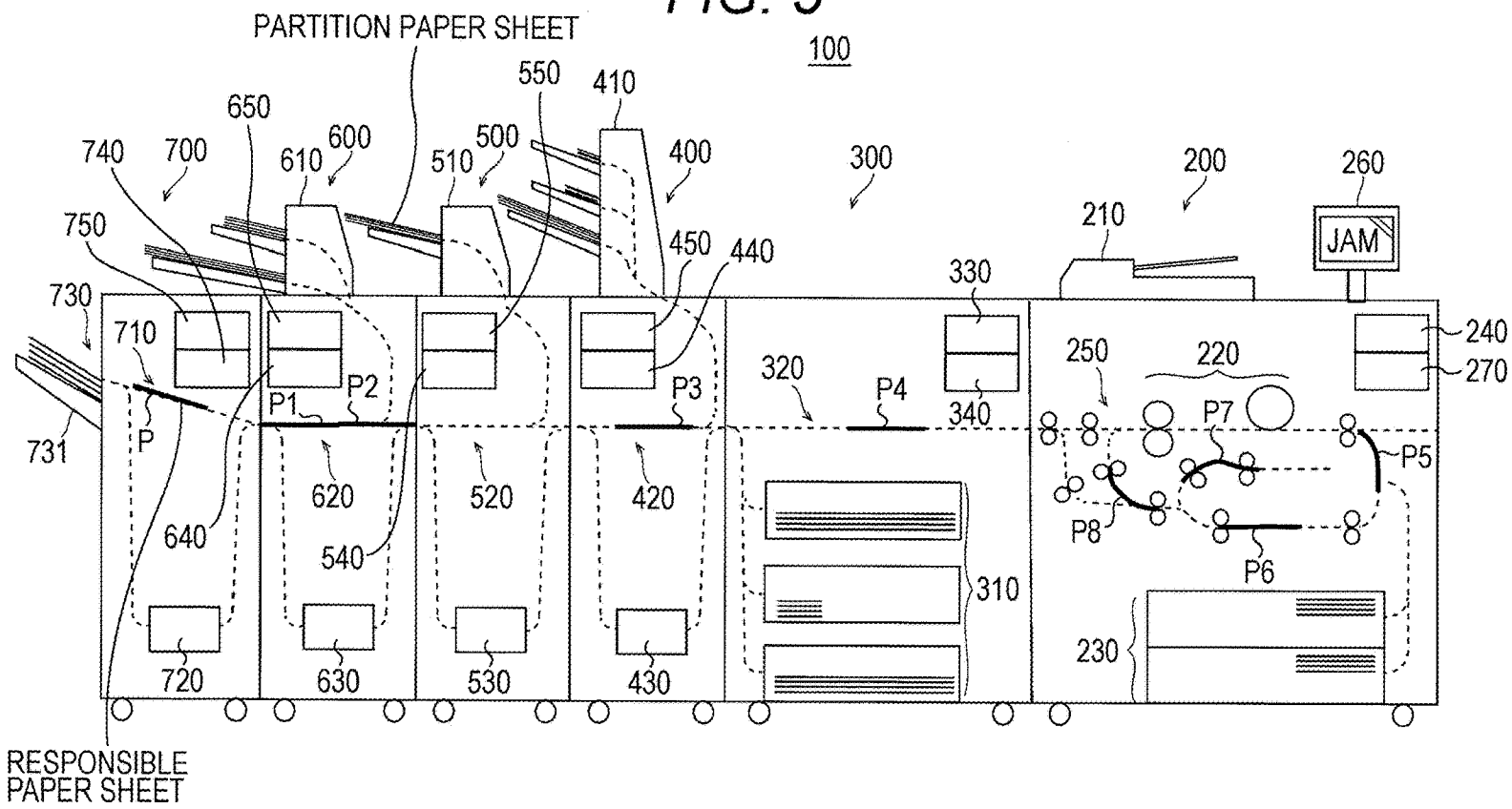
FIG. 5 is a schematic cross-sectional view illustrating another exemplary action of the image formation system according to the first embodiment of the invention.

Next, a control method according to the first embodiment will be described in detail with reference to FIGS. 3A, 3B, 4, and 5. FIG. 3A is a flowchart exemplifying a main routine of the control method according to the first embodiment, whereas FIG. 3B is a subroutine flowchart exemplifying "jam processing" illustrated in FIG. 3A. Meanwhile, FIG. 4 is a schematic cross-sectional view illustrating an exemplary action of the image formation system according to the first embodiment. In addition, FIG. 5 is a schematic cross-sectional view illustrating another exemplary action of the image formation system according to the first embodiment.

Respective processing tasks in the control method illustrated in FIGS. 3A and 3B are implemented by the control unit 270, the control unit 340, the control unit 450, the control unit 550, the control unit 650, and the control unit 750 executing the respective control programs to work in coordination with one another. Note that a case where the control unit 270 plays a leading role between the control unit 340, the control unit 450, the control unit 550, the control unit 650, and the control unit 750 will be described hereinafter for reasons of convenience but the embodiment is not limited to such a case.

In addition, the following description will mainly exemplify a case where the paper sheets in the print job are all specified to A4 size white paper sheets and a paper jam has been detected in the fourth post-processing device 700, for convenience of description. However, the embodiment is not limited to such a case.

As illustrated in FIG. 3A, print processing is first carried out (step S101). The control unit 270 forms an image on the paper sheet supplied from the paper feeder 230 on the basis of the print job received from the client terminal or the like. The paper sheet on which the image has been formed is discharged to the paper ejection tray 731 in the fourth post-processing device 700 as the usable paper sheet after passing through the insertion paper feeding device 300, the first post-processing device 400, the second post-processing device 500, and the third post-processing device 600.

Subsequently, whether the paper jam has been detected is determined (step S102). The control unit 270 determines, on the basis of jam occurrence information, whether the paper jam has been detected in at least one of the paper conveyance passages in the image formation system 100. When the paper jam has not been detected (step S102: NO), the processing returns to step S101 and the print processing is continuously carried out.

On the other hand, when the paper jam has been detected (step S102: YES), the print processing is suspended and the jam processing is carried out (step S103). Details of processing content of the jam processing will be described later.

Subsequently, the partition paper sheet is inserted on the paper ejection tray 731 after the jam processing is finished (step S104). The control unit 270 supplies the partition paper sheet from the paper inserter 510 and controls such that the partition paper sheet is inserted on the paper ejection tray 731 by way of the paper conveyor 520, the paper conveyor 620, and the paper conveyor 710.

Subsequently, a remaining paper sheet is automatically purged (step S105). The control unit 270 again conveys the remaining paper sheet stopped at a position available for purging in the paper conveyance passage in each of the devices in the image formation system 100 to discharge the remaining paper sheet to the outside of the image formation system 100. Thereafter, the control unit 270 terminates the processing (end).

As described above, in the processing illustrated in FIG. 3A, the control unit 270 suspends the print processing to carry out the jam processing when the jam is detected in the paper conveyance passage while the print processing is being carried out. The control unit 270 inserts the partition paper sheet on the paper ejection tray 731 after the jam processing is completed and then carries out the automatic purge, namely, again conveys the remaining paper sheet in the paper conveyance passage to discharge the same to the paper ejection tray 731.

<Jam Processing (Step S103)>

As illustrated in FIG. 3B, the paper sheet located on a downstream side of a responsible paper sheet is discharged (step S201). When the paper jam is detected in the device situated upstream of the fourth post-processing device 700, the control unit 270 discharges the paper sheet located on the downstream side of the responsible paper sheet to the paper ejection tray 731. For example, when the paper jam is detected in the third post-processing device 600, the control unit 270 continues the conveyance of the paper sheet by the fourth post-processing device 700 and discharges the paper sheet located downstream of the responsible paper sheet to the paper ejection tray 731.

On the other hand, in the example illustrated in FIG. 4, when the paper jam is detected in the fourth post-processing device 700, the control unit 270 does not carry out the discharging action for the paper sheet located on the downstream side of the responsible paper sheet because there is no device situated downstream of the fourth post-processing device 700.

Subsequently, the conveyance of the paper sheet on the upstream side of the responsible paper sheet is stopped (step S202). For example, as illustrated in FIG. 4, when the paper jam is detected in the fourth post-processing device 700, the control unit 270 immediately stops to drive the conveyance of the responsible paper sheet while controlling such that the paper sheet being conveyed in the paper conveyance passage in the device situated upstream of the second post-processing device 500 including the dedicated insertion tray is stopped at a predetermined escape position. In the example illustrated in FIG. 4, in an upstream area of the second post-processing device 500, a remaining paper sheet P3 is stopped in the first post-processing device 400, a remaining paper sheet P4 is stopped in the insertion paper feeding device 300, and remaining paper sheets P5 to P8 are stopped in the image formation device 200. The predetermined escape position described above is at least a position in the image formation unit 220 in the image formation device 200 other than the vicinity of a transfer unit and a fixing unit and also available for the automatic purge of the paper sheets stopped in the respective devices.

Meanwhile, when the paper jam is detected in the post-processing device situated upstream of the fourth post-processing device 700, the control unit 270 controls such that the paper sheet being conveyed on the upstream side of the position of the responsible paper sheet in the paper conveyance passage in the device situated upstream of the post-processing device including the dedicated insertion tray is stopped at the predetermined escape position.

Subsequently, whether the remaining paper sheet stays in a conveyance route for the partition paper sheet is determined (step S203). The conveyance route for the partition paper sheet is a conveyance route for the partition paper sheet extending from the paper inserter 510 configured to supply the partition paper sheet to the paper ejection tray 731. The paper sheet located on the downstream side of the responsible paper sheet has been already discharged at step S201 and thus, the paper sheet is not present in the conveyance route from the responsible paper sheet to the paper ejection tray 731. Accordingly, when the remaining paper sheet is assumed to be present anywhere in the conveyance route for the partition paper sheet, an area from the paper inserter 510 to the responsible paper sheet is suspected within the entire conveyance route for the partition paper sheet. The control unit 270 locates the remaining paper sheet present in the paper conveyance passages in the image formation system 100 on the basis of the paper information on the print job and detection results by the paper detection sensors 251, 321, 421, 521, 621, and 721 and then acquires a position thereof. When the remaining paper sheet does not stay in the conveyance route for the partition paper sheet (step S203: NO), the processing moves to processing at step S207.

On the other hand, when the remaining paper sheet stays in the conveyance route for the partition paper sheet (step S203: YES), whether the remaining paper sheet in the conveyance route for the partition paper sheet can be shifted closer to the downstream side is determined (step S204). The control unit 270 determines whether an area on the downstream side has room for shifting the remaining paper sheet in the conveyance route for the partition paper sheet thereto. When the remaining paper sheet in the conveyance route for the partition paper sheet cannot be shifted closer to the downstream side (step S204: NO), the processing moves to processing at step S206.

On the other hand, when the remaining paper sheet in the conveyance route for the partition paper sheet can be shifted closer to the downstream side (step S204: YES), the remaining paper sheet in the conveyance route for the partition paper sheet is shifted closer to the downstream side (step S205). For example, as illustrated in FIG. 5, the control unit 270 shifts the remaining paper sheet P2 in the paper conveyance passage in the second post-processing device 500 to the paper conveyance passage in the third post-processing device 600 to stop there.

More specifically, the control unit 270 moves the remaining paper sheet P1 in the paper conveyance passage in the third post-processing device 600 to shift closer to the responsible paper sheet side in a downstream direction such that an entrance of the paper conveyance passage is not blocked by the remaining paper sheet P1, while moving the remaining paper sheet P2 in the second post-processing device 500 to the third post-processing device 600.

In order to house both of the remaining paper sheet P1 and the remaining paper sheet P2 within the paper conveyance passage in the third post-processing device 600, the remaining paper sheet P1 can be moved to a most downstream area in the paper conveyance passage in the third post-processing device 600. Alternatively, the remaining paper sheet P2 may be moved to the downstream side until reaching a position where a trailing edge of the remaining paper sheet P1 makes contact with a leading edge of the remaining paper sheet P2. Furthermore, as will be described later, considering a fact that the remaining paper sheets P1 and P2 are to be removed by the user and treated as the unusable paper sheets, it is also possible to bend the remaining paper sheets P1 and P2 to house within the paper conveyance passage in the third post-processing device 600 up to an extent where the removal does not become difficult for the user.

Note that, when the remaining paper sheets P1 and P2 are shifted closer to the downstream side, information regarding the positions of the remaining paper sheets P1 and P2 after being moved is updated.

As described above, by shifting the remaining paper sheet in the conveyance route for the partition paper sheet to the post-processing device on the downstream side, the number of the post-processing devices containing therein the remaining paper sheets supposed to be removed by the user can be reduced. In a case where the one remaining paper sheet P1 is caused to stop so as to be left across the plurality of post-processing devices, the remaining paper sheet P1 is housed within one post-processing device after being shifted closer to the downstream side. In addition, in a case where the plurality of paper sheets are to be removed, as a consequence of shifting the plurality of remaining paper sheets P1 and P2 and so on caused to stop while being laid across the plurality of post-processing devices, the remaining paper sheets P1 and P2 and so on are gathered to a less number of the post-processing devices to be housed therewithin. Accordingly, the number of times for the user to open doors of the post-processing devices in order to remove the remaining paper sheets can be decreased.

Subsequently, the remaining paper sheet in the conveyance route for the partition paper sheet is included into the paper sheets to be removed (step S206). The remaining paper sheet in the conveyance route for the partition paper sheet prevents the partition paper sheet from being conveyed. Therefore, the remaining paper sheet in the conveyance route for the partition paper sheet needs to be removed. In the example in FIG. 4 or 5, the control unit 270 includes, in addition to the responsible paper sheet, the remaining paper sheets in the conveyance route for the partition paper sheet positioned upstream of the responsible paper sheet, namely, the remaining paper sheet P1 and the remaining paper sheet P2 into the paper sheets to be removed.

Subsequently, the paper sheets to be removed are notified (step S207). The control unit 270 displays information such as positions of the paper sheets to be removed on the display of the operation display unit 260, thereby prompting the user to remove the paper sheets to be removed from the image formation system 100. When the remaining paper sheet does not stay in the conveyance route for the partition paper sheet, only the responsible paper sheet serves as the paper sheet to be removed. Meanwhile, when the remaining paper sheet stays in the conveyance route for the partition paper sheet, the responsible paper sheet and this remaining paper sheet serve as the paper sheets to be removed. As described above, by outputting a notification also about the position of the remaining paper sheet in the conveyance route for the partition paper sheet in addition to the position of the responsible paper sheet, the convenience when the user removes this remaining paper sheet can be enhanced.

Subsequently, it is determined whether the removal of the paper sheets to be removed is completed (step S208). The control unit 270 determines whether the paper sheets to be removed have been removed from the image formation system 100. The user removes the paper sheets to be removed from the image formation system 100 in accordance with the information displayed on the display of the operation display unit 260 such as the positions of the paper sheets to be removed.

For example, in a case where the remaining paper sheet P2 has not been shifted to the third post-processing device 600 on the downstream side as illustrated in FIG. 4, the user needs to remove the remaining paper sheet P1 from the third post-processing device 600 and also needs to remove the remaining paper sheet P2 from the second post-processing device 500. On the other hand, in a case where the control unit 270 has shifted the remaining paper sheet P2 to the third post-processing device 600 on the downstream side as illustrated in FIG. 5, the user can remove the remaining paper sheets P1 and P2 together at once from the third post-processing device 600. Accordingly, when the remaining paper sheets P1 and P2 are shifted to the third post-processing device 600 on the downstream side, a load on the user when taking away the remaining paper sheets P1 and P2 from the image formation system 100 can be mitigated.

When the removal of the paper sheets to be removed is not completed (step S208: NO), the control unit 270 is kept in a standby state while continuing the display for prompting the removal of the paper sheets to be removed on the display until the paper sheets to be removed are removed from the image formation system 100.

On the other hand, when the removal of the paper sheets to be removed by the user is completed (step S208: YES), the jam processing is terminated to return to the flowchart in FIG. 3A and then, the processing moves to the processing at step S104 (return).

The image formation system 100 according to the embodiment described thus far achieves the following effects.

The partition paper sheet for distinguishing the unusable paper sheet from the usable paper sheet on the paper ejection tray 731 is inserted on the paper ejection tray 731 before this unusable paper sheet is discharged to the paper ejection tray 731. Accordingly, the user can distinguish the usable paper sheet and the unusable paper sheet from each other with ease when the usable paper sheet and the unusable paper sheet are discharged to one and the same paper ejection tray 731.

Second Embodiment

The first embodiment has described a case where the dedicated insertion tray is included in the post-processing device. The second embodiment will describe a case where the insertion tray for the partition paper sheet is chosen from among the plurality of insertion trays included in the post-processing devices instead of using the dedicated insertion tray included in the post-processing device. Note that, in order to avoid a duplicated description, descriptions of the same configurations as those in the first embodiment will be omitted.

Figure 6:
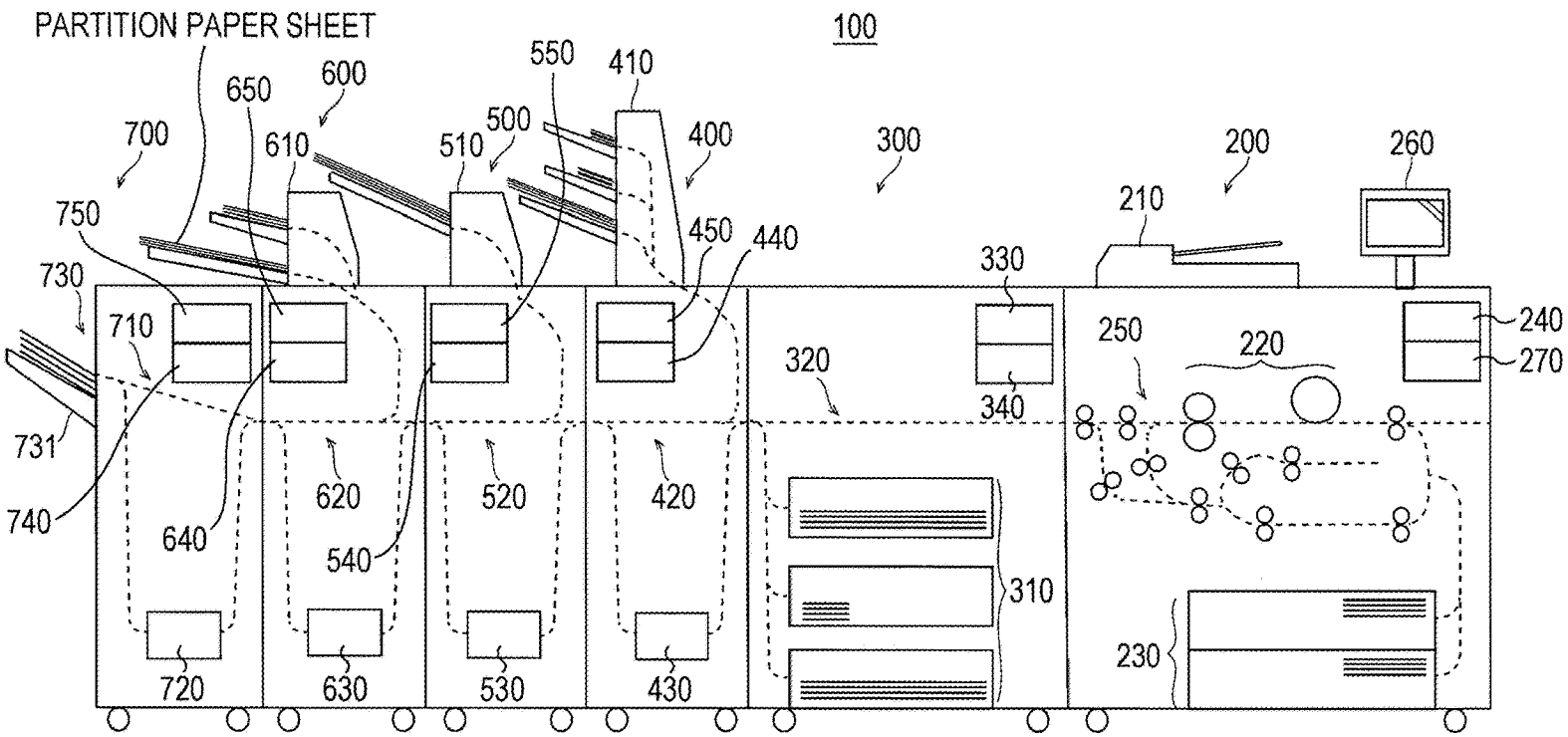
FIG. 6 is a schematic cross-sectional view exemplifying a configuration of an image formation system according to a second embodiment of the invention.
Figure 7B:
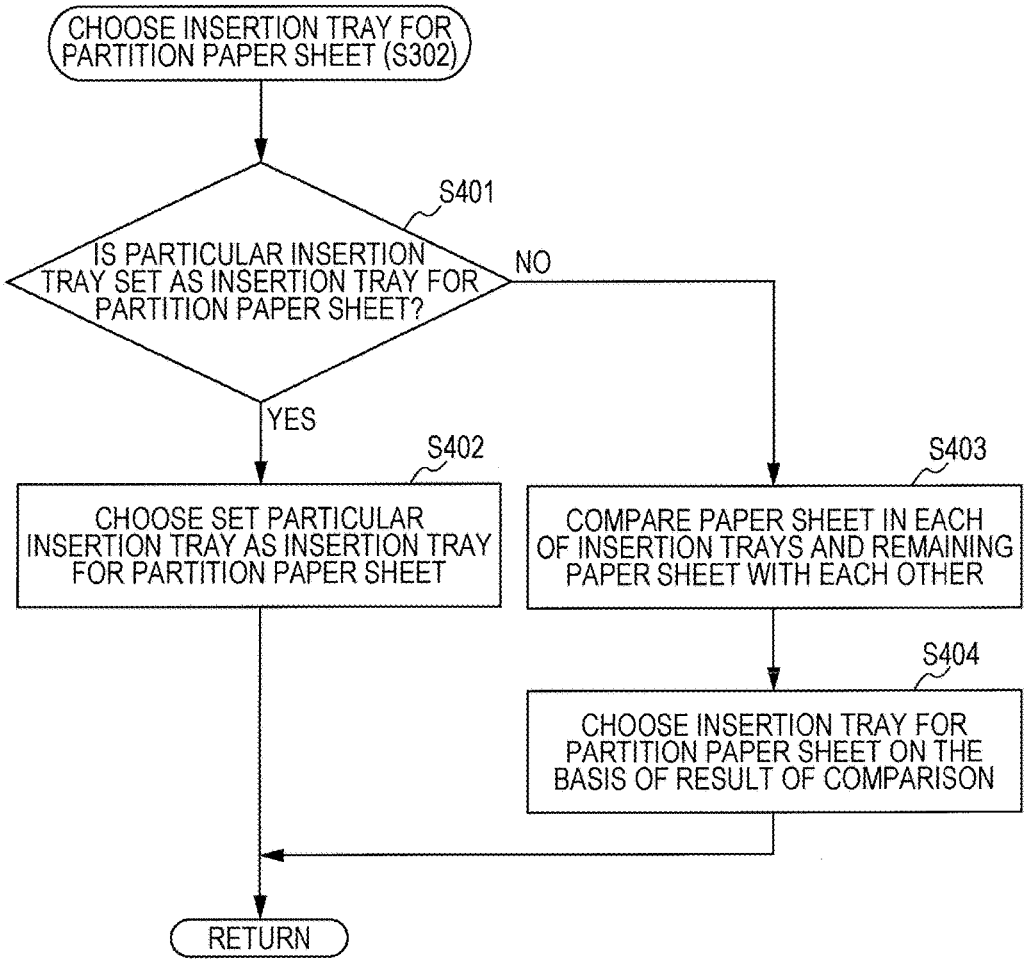
FIG. 7B is a subroutine flowchart exemplifying "choose insertion tray for partition paper sheet" in FIG. 7A.
Figure 8:
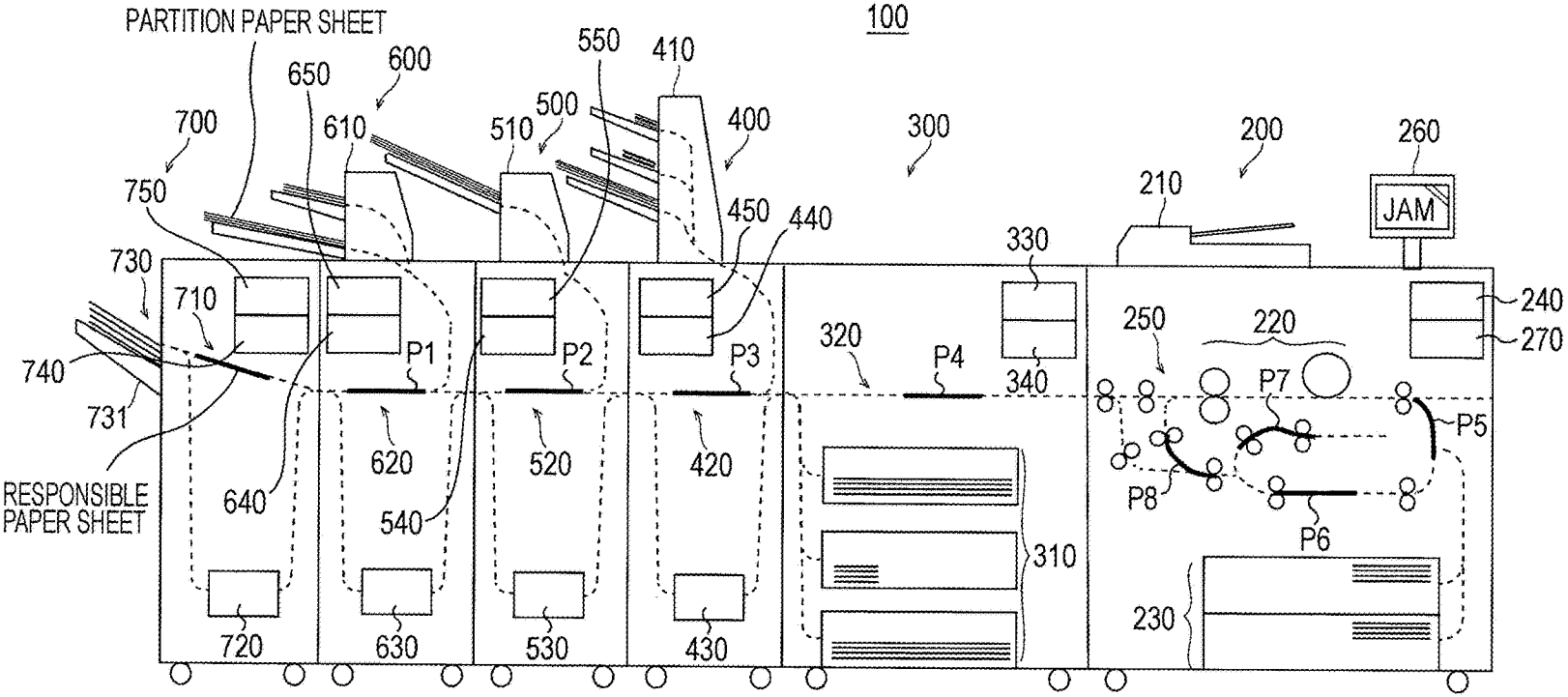
FIG. 8 is a schematic cross-sectional view exemplifying an action of the image formation system according to the second embodiment of the invention.

An image formation system according to the second embodiment will be described with reference to FIGS. 6, 7A, 7B, and 8. FIG. 6 is a schematic cross-sectional view exemplifying a configuration of the image formation system according to the second embodiment. Meanwhile, FIG. 7A is a subroutine flowchart exemplifying "jam processing" according to the second embodiment, whereas FIG. 7B is a subroutine flowchart exemplifying "choose insertion tray for partition paper sheet" in FIG. 7A. In addition, FIG. 8 is a schematic cross-sectional view exemplifying an action of the image formation system according to the second embodiment.

Respective processing tasks in a control method illustrated in FIGS. 7A and 7B are implemented by a control unit 270, a control unit 340, a control unit 450, a control unit 550, a control unit 650, and a control unit 750 executing the respective control programs to work in coordination with one another. Note that a case where the control unit 270 plays a leading role between the control unit 340, the control unit 450, the control unit 550, the control unit 650, and the control unit 750 will be described hereinafter for reasons of convenience but the embodiment is not limited to such a case.

<Image Formation System 100>

As illustrated in FIG. 6, in the embodiment, the image formation system 100 has an image formation device 200, an insertion paper feeding device 300, a first post-processing device 400, a second post-processing device 500, a third post-processing device 600, and a fourth post-processing device 700 as in the first embodiment. Especially in the embodiment, however, a paper inserter 510 of the second post-processing device 500 does not include the dedicated insertion tray unlike the first embodiment.

Meanwhile, in the embodiment, for example, a smallest size paper sheet is set in the insertion tray at an upper level, the B5 size paper sheet is set in the insertion tray at a middle level, and the A3 size paper sheet is set in the insertion tray at a lower level in a paper inserter 410. In addition, for example, the B3 size paper sheet is set in the insertion tray in the paper inserter 510, while the A4 size paper sheet and the B3 size paper sheet are set in the insertion trays at an upper level and a lower level, respectively, in a paper inserter 610. The paper information on the paper sheets set in the respective insertion trays is saved in the insertion tray information.

In the embodiment, the insertion tray for the partition paper sheet is chosen from among the plurality of insertion trays included in the paper inserter 410, the paper inserter 510, and the paper inserter 610. The insertion tray for the partition paper sheet can be set by the user in advance from among the aforementioned plurality of insertion trays. In addition, in a case where the insertion tray for the partition paper sheet is not set by the user, the control unit 270 can choose a proper insertion tray from among the aforementioned plurality of insertion trays. Information regarding the setting of the insertion tray for the partition paper sheet is saved in, for example, the insertion tray information.

<Control Method>

A main routine of the control method according to the embodiment is similar to the main routine of the control method according to the first embodiment and thus, a detailed description will be omitted.

<Jam Processing>

As illustrated in FIG. 7A, "choose insertion tray for partition paper sheet" (step S302) is added to the jam processing according to the embodiment, compared to the jam processing according to the first embodiment (the subroutine flowchart in FIG. 3B). Steps S301 and S303 to S309 except step S302 individually correspond to steps S201 to S208 according to the first embodiment. Specific processing in "choose insertion tray for partition paper sheet" at step S302 is as illustrated in the subroutine flowchart in FIG. 7B.

As illustrated in FIG. 7B, whether a particular insertion tray is set as the insertion tray for the partition paper sheet is first determined (step S401). The control unit 270 determines whether a particular insertion tray is set by the user as the insertion tray for the partition paper sheet. When a particular insertion tray is set as the insertion tray for the partition paper sheet (step S401: YES), the set particular insertion tray is chosen as the insertion tray for the partition paper sheet (step S402). Thereafter, the control unit 270 returns to the subroutine flowchart in FIG. 7A to move to processing at step S303 (return).

On the other hand, when a particular insertion tray is not set as the insertion tray for the partition paper sheet (step S401: NO), the paper sheet in each of the insertion trays and the remaining paper sheet are compared with each other (step S403). The control unit 270 acquires the paper information on the paper sheet set in each of the insertion trays from the insertion tray information and also acquires the paper information on the remaining paper sheet on the basis of the print job and detection results from paper detection sensors 251, 321, 421, 521, 621, and 721. The control unit 270 compares the paper information on the paper sheet set in the insertion tray in each of the paper inserter 410, the paper inserter 510, and the paper inserter 610 with the paper information on the remaining paper sheet.

Subsequently, the insertion tray for the partition paper sheet is chosen on the basis of a result of the comparison (step S404). The control unit 270 chooses the insertion tray satisfying a predetermined choice reference as the insertion tray for the partition paper sheet on the basis of a result of the comparison between the paper sheet in each of the insertion trays and the remaining paper sheet. A fact that the set paper sheet has a difference in comparison with the remaining paper sheet functions as the predetermined choice reference, examples of which include a fact that the size of the paper sheet is larger than that of the remaining paper sheet and a fact that a color of the paper sheet is different from a color of the remaining paper sheet. For example, in a case where the paper sheets in the print job are all specified to A4 size white paper sheets, the control unit 270 searches for the insertion tray in which the paper sheet having a different size from the A4 size and/or a different color is set, on the basis of the paper information on the respective insertion trays saved in an auxiliary storage device of the control unit 270 and then chooses the found insertion tray as the insertion tray for the partition paper sheet.

Note that, in a case where there is the plurality of insertion trays satisfying the predetermined choice reference described above, the control unit 270 chooses the insertion tray positioned most downstream as the insertion tray for the partition paper sheet. For example, the insertion trays satisfying the predetermined choice reference in the example in FIG. 8 are the insertion tray at the lower level in the paper inserter 410 (A3 size), the insertion tray in the paper inserter 510 (B3 size), and the insertion tray at the lower level in the paper inserter 610 (B3 size). In a case where there is the plurality of insertion trays satisfying the predetermined choice reference and capable of supplying the partition paper sheet, the control unit 270 chooses, as the insertion tray for the partition paper sheet, the insertion tray positioned immediately upstream from the paper ejection tray 731, namely, the insertion tray at the lower level in the paper inserter 610 positioned most downstream among these insertion trays. Thereafter, the control unit 270 returns to the subroutine flowchart in FIG. 7A to move to processing at step S303 (return).

As described above, by choosing the insertion tray positioned immediately upstream from the paper ejection tray 731 as the insertion tray for the partition paper sheet, the conveyance route for the partition paper sheet extending from the insertion tray for the partition paper sheet to the paper ejection tray 731 can be shortened. With this, the number of the remaining paper sheets that the user is required to remove from the conveyance route for the partition paper sheet can be reduced. In addition, when the conveyance route for the partition paper sheet is shortened, it is possible to suppress the occurrence of another jam caused by the conveyance of the partition paper sheet. Furthermore, a time until the partition paper sheet is inserted on the paper ejection tray 731 can be made shorter.

For example, in the example illustrated in FIG. 8, the control unit 270 includes the remaining paper sheet P1 located in the conveyance route for the partition paper sheet extending from the paper inserter 410 to the paper ejection tray 731 into the paper sheets to be removed and then prompts the user to remove the relevant paper sheets to be removed. After the user removes the paper sheets to be removed, namely, the responsible paper sheet and the remaining paper sheet P1, the control unit 270 inserts the partition paper sheet on the paper ejection tray 731 and then carries out the automatic purge on the remaining paper sheets P2 to P6.

As described in the first embodiment, in a case where the partition paper sheet is inserted on the paper ejection tray 731 from the paper inserter 510, the user needs to remove the remaining paper sheets P1 and P2 located in the conveyance route for the partition paper sheet extending from the paper inserter 510 to the paper ejection tray 731. In contrast to this, in the embodiment, the remaining paper sheet P1 serves as only one object that the user needs to remove from the conveyance route for the partition paper sheet. Consequently, the remaining paper sheets that the user is required to remove from the conveyance route for the partition paper sheet can be reduced by one in the embodiment, compared to a case where the partition paper sheet is inserted on the paper ejection tray 731 from the paper inserter 510.

In addition, when choosing the insertion tray for the partition paper sheet, the control unit 270 also can use the paper information on the usable paper sheet discharged to the paper ejection tray 731 instead of the paper information on the remaining paper sheet. Alternatively, the control unit 270 also can choose the insertion tray for the partition paper sheet on the basis of the paper information on the remaining paper sheet and the paper information on the usable paper sheet. Specifically, it is also possible for the control unit 270 to compare at least one of the paper information on the usable paper sheet and the paper information on the remaining paper sheet with information on the paper sheet in each of the insertion trays and then choose the insertion tray for the partition paper sheet on the basis of a result of the comparison.

Variations

Figure 9:
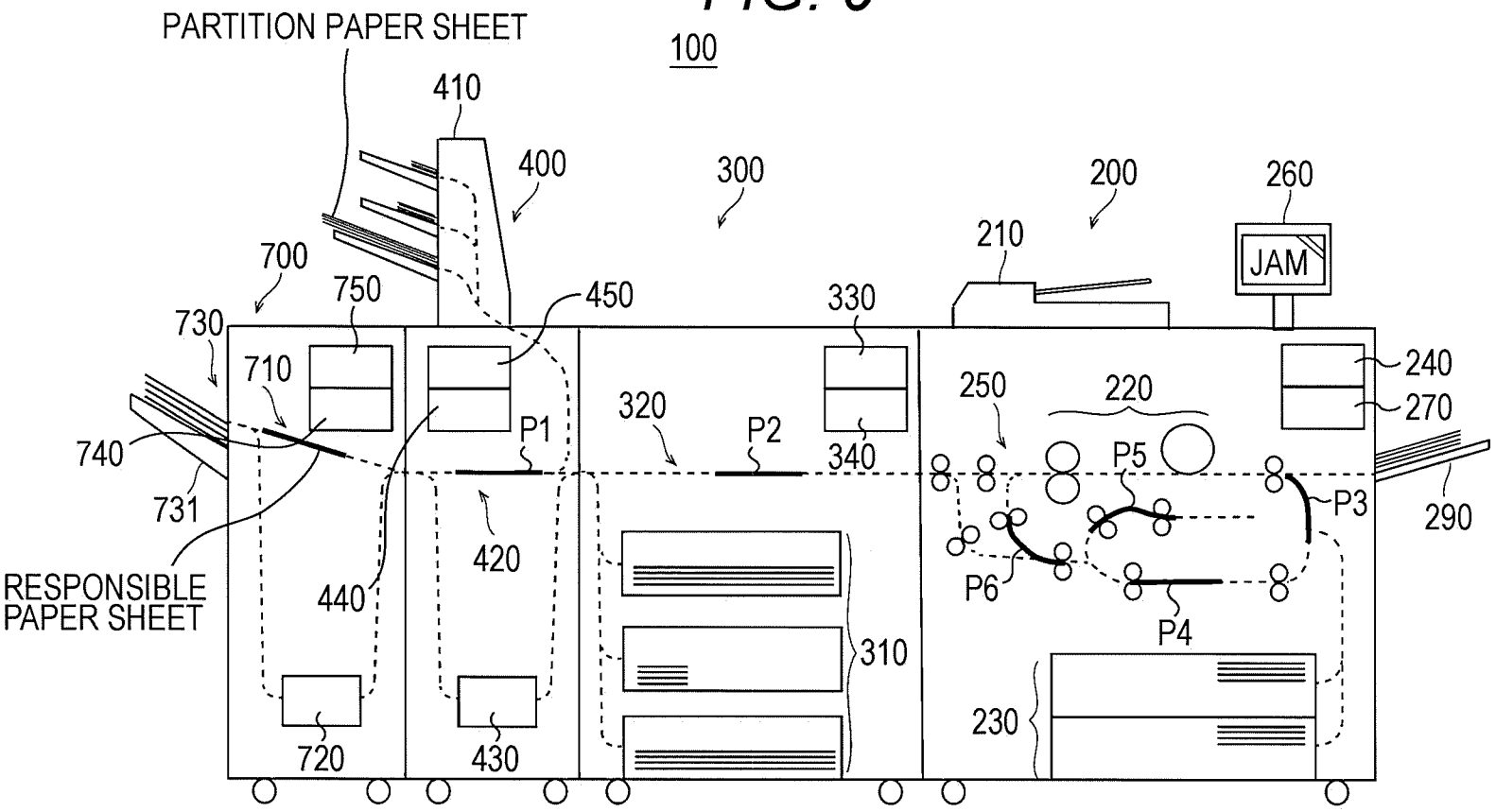
FIG. 9 is a schematic cross-sectional view exemplifying an action of an image formation system according to a variation of the second embodiment of the invention.

Next, a variation of the embodiment will be described with reference to FIG. 9. FIG. 9 is a schematic cross-sectional view exemplifying an action of an image formation system according to a variation of the second embodiment.

The image formation system 100 according to the variation differs from the aforementioned image formation system 100 in not having the second post-processing device 500 and the third post-processing device 600 in such a manner that a first post-processing device 400 is arranged between an insertion paper feeding device 300 and a fourth post-processing device 700. Meanwhile, an image formation device 200 further has a manual feed tray 290 in addition to a paper feeder 230. An image formation unit 220 also can form an image on the paper sheet supplied from the manual feed tray 290.

Additionally, also in the variation, for example, a smallest size paper sheet is set in the insertion tray at an upper level, the B5 size paper sheet is set in the insertion tray at a middle level, and the A3 size paper sheet is set in the insertion tray at a lower level in a paper inserter 410.

In the variation, the insertion tray for the partition paper sheet is chosen from among the plurality of insertion trays included in the paper inserter 410. The insertion tray for the partition paper sheet can be set by the user in advance from among the aforementioned plurality of insertion trays. In addition, in a case where the insertion tray for the partition paper sheet is not set by the user, a control unit 270 can choose a proper insertion tray from among the aforementioned plurality of insertion trays.

In the example illustrated in FIG. 9, in a case where the paper sheets in the print job are all specified to A4 size white paper sheets, the insertion tray at the lower level in the paper inserter 410 (A3 size) serves as only one insertion tray satisfying the predetermined choice reference described above. Accordingly, the control unit 270 chooses the insertion tray at the lower level in the paper inserter 410 as the insertion tray for the partition paper sheet.

The control unit 270 includes the remaining paper sheet P1 located in the conveyance route for the partition paper sheet extending from the paper inserter 410 to the paper ejection tray 731 into the paper sheets to be removed and then prompts the user to remove the relevant paper sheets to be removed, namely, the responsible paper sheet and the remaining paper sheet P1. After the user removes the paper sheets to be removed, the control unit 270 inserts the partition paper sheet on the paper ejection tray 731 and then carries out the automatic purge on the remaining paper sheets P2 to P6.

The image formation system 100 according to the embodiment described thus far achieves the following effects in addition to the effects in the first embodiment.

The insertion tray for the partition paper sheet is chosen from among the plurality of insertion trays included in the image formation system 100 and thus, a proper partition paper sheet can be inserted on the paper ejection tray 731 in accordance with the type of the remaining paper sheet.

The image formation systems and the control programs according to the invention have been described in the embodiments thus far. However, it is apparent that the invention can be added, modified, and omitted by a person skilled in the art as appropriate without departing from the scope of the technical concept thereof.

For example, the first and second embodiments have described a case where the partition paper sheet is supplied from the paper inserter in the post-processing device. However, the invention is not limited to the case where the partition paper sheet is supplied from the paper inserter in the post-processing device and the partition paper sheet can be also supplied from the insertion paper feeding device.

Meanwhile, the first and second embodiments have described a case where the user is notified of the paper sheets to be removed through information displayed on the display of the operation display unit, including the positions of the paper sheets to be removed. However, the invention is not limited to such a case. For example, the user also can be notified of the paper sheets to be removed through information communicated to the user by using audio or the like, including the positions of the paper sheets to be removed.

In addition, the first and second embodiments have described a case where the paper sheet is used as the partition paper sheet but a sheet material such as a resin film also can be used as the partition paper sheet.

Furthermore, the first and second embodiments have described a case where the image formation system includes one paper ejection tray and the usable paper sheet and the unusable paper sheet are discharged to this paper ejection tray. However, the invention is not limited to such a case. The invention also can be applied to a case where the image formation system includes the plurality of paper ejection trays and the usable paper sheet and the unusable paper sheet are discharged to one particular paper ejection tray thereamong.

Additionally, the first and second embodiments have described a case where the paper ejection tray is included in the post-processing device situated most downstream. However, the invention is not limited to such a case and the paper ejection tray may be included in a post-processing device other than the post-processing device situated most downstream.

As for the number of the partition paper sheets to be inserted on the paper ejection tray before the automatic purge, although one partition paper sheet is usually enough, the number thereof is not limited to one. The plural number of partition paper sheets can be inserted on the paper ejection tray as necessary.

Meanwhile, the control program for causing the image formation system to work may be provided through a computer-readable recording medium such as a USB memory, a flexible disk, and a CD-ROM, or alternatively, may be provided online via a network such as the Internet. In this case, usually, the program recorded in the computer-readable recording medium is transferred to a memory or a storage to be stored therein. In addition, this control program may be provided as, for example, independent application software, or alternatively, may be incorporated into software of each of the devices in the image formation system as one function thereof.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image formation system including an image formation device and a post-processing device configured to either convey a paper sheet on which an image has been formed at the image formation device or carry out post-processing thereon, the image formation system comprising:

a paper ejection tray on which the discharged paper sheet is placed;

a jam detector configured to detect a jam of the paper sheet conveyed in a paper conveyance passage;

a partition paper sheet inserter configured to insert a partition paper sheet on the paper ejection tray by way of the paper conveyance passage; and a control unit, wherein the control unit controls the partition paper sheet inserter such that, after the jam is detected by the jam detector and paper sheets to be removed, at least including a responsible paper sheet acting as a cause of the jam, are removed, the partition paper sheet is inserted on the paper ejection tray before the paper sheet remaining in the paper conveyance passage is conveyed to be discharged to the paper ejection tray.

2. The image formation system according to claim 1, wherein the paper sheets to be removed include the responsible paper sheet and a paper sheet remaining in a conveyance route for the partition paper sheet extending from the partition paper sheet inserter to the paper ejection tray, which paper sheet is positioned upstream of the responsible paper sheet in a paper conveyance direction.

3. The image formation system according to claim 1, wherein in a case where the jam is detected by the jam detector and there is a paper sheet remaining in a conveyance route for the partition paper sheet extending from the partition paper sheet inserter to the paper ejection tray, which paper sheet is positioned upstream of the responsible paper sheet in a paper conveyance direction, the control unit makes a notification to a user to prompt the removal of this paper sheet by regarding this paper sheet as the paper sheet to be removed.

4. The image formation system according to claim 1, further comprising a display unit, wherein the control unit, after the jam is detected by the jam detector, locates a paper sheet remaining in a conveyance route for the partition paper sheet extending from the partition paper sheet inserter to the paper ejection tray, which paper sheet is positioned upstream of the responsible paper sheet in a paper conveyance direction, and displays, on the display unit, this paper sheet and the responsible paper sheet as the paper sheets to be removed, and controls the partition paper sheet inserter such that the partition paper sheet is inserted on the paper ejection tray after the paper sheets to be removed are removed.

5. The image formation system according to claim 1, further comprising a plurality of paper inserters as the partition paper sheet inserters, each of which is capable of supplying the partition paper sheet, wherein the control unit controls such that the partition paper sheet is inserted on the paper ejection tray from the paper inserter positioned immediately upstream from the paper ejection tray in a paper conveyance direction among the plurality of paper inserters, by way of the paper conveyance passage.

6. The image formation system according to claim 1, further comprising at least one paper inserter as the partition paper sheet inserter, which is capable of supplying the partition paper sheet, wherein the control unit controls such that the partition paper sheet is inserted on the paper ejection tray from the paper inserter set in advance, byway of the paper conveyance passage.

7. The image formation system according to claim 1, further comprising a plurality of paper inserters as the partition paper sheet inserters, each of which is capable of supplying the partition paper sheet, wherein the control unit chooses the paper inserter to be used, on the basis of at least one of paper information on the paper sheet ejected to the paper ejection tray and paper information on the paper sheet remaining in the paper conveyance passage, as well as paper information on the paper sheets set in the plurality of paper inserters, and controls such that the partition paper sheet is inserted on the paper ejection tray from the chosen paper inserter by way of the paper conveyance passage.

8. The image formation system according to claim 1, further comprising the plurality of post-processing devices, wherein after the jam is detected by the jam detector, the control unit locates a paper sheet remaining in a conveyance route for the partition paper sheet extending from the partition paper sheet inserter to the paper ejection tray, which paper sheet is positioned upstream of the responsible paper sheet in a paper conveyance direction, and shifts the paper sheet to the paper conveyance passage in the post-processing device arranged upstream of a position of the responsible paper sheet but on a downstream side of a position of the paper sheet, to stop there.

9. The image formation system according to claim 1, wherein after the jam is detected by the jam detector, the control unit moves a paper sheet being conveyed in the paper conveyance passage situated upstream of the paper sheet to be removed in a paper conveyance direction to a predetermined escape position available for purging, thereafter to stop there.

10. A non-transitory recording medium storing a computer readable control program for an image formation system including an image formation device and a post-processing device configured to either convey a paper sheet on which an image has been formed at the image formation device or carry out post-processing thereon, the control program for causing a computer to execute:

a procedure of discharging the paper sheet on which an image has been formed at the image formation device to a paper ejection tray installed at the post-processing device;

a procedure of detecting a jam of the paper sheet in a paper conveyance passage in the image formation system;

a procedure of, after paper sheets to be removed, at least including a responsible paper sheet acting as a cause of the jam, are removed, inserting a partition paper sheet on the paper ejection tray by way of the paper conveyance passage before a paper sheet remaining in the paper conveyance passage is conveyed to be discharged to the paper ejection tray; and a procedure of discharging the remaining paper sheet in the paper conveyance passage to the paper ejection tray.

11. The non-transitory recording medium storing a computer readable control program according to claim 10, wherein the paper sheets to be removed include the responsible paper sheet and a paper sheet remaining in a conveyance route for the partition paper sheet extending from a position where the partition paper sheet is inserted into the paper conveyance passage to the paper ejection tray, which paper sheet is positioned upstream of the responsible paper sheet in a paper conveyance direction.

12. The non-transitory recording medium storing a computer readable control program according to claim 10, wherein in the procedure of carrying out jam processing, in a case where there is the responsible paper sheet acting as a cause of the jam and a paper sheet remaining in a conveyance route for the partition paper sheet, which paper sheet is positioned upstream of the responsible paper sheet in a paper conveyance direction, a notification is made to a user to prompt the removal of these paper sheets by regarding these paper sheets as the paper sheets to be removed.

13. The non-transitory recording medium storing a computer readable control program according to claim 10, the control program for causing the computer to execute:

a procedure of, after the jam is detected, locating a paper sheet remaining in a conveyance route for the partition paper sheet extending from a position where the partition paper sheet is inserted into the paper conveyance passage to the paper ejection tray, which paper sheet is positioned upstream of the responsible paper sheet in a paper conveyance direction, and displaying, on a display unit, this paper sheet and the responsible paper sheet as the paper sheets to be removed; and a procedure of, after the paper sheets to be removed are removed, inserting the partition paper sheet on the paper ejection tray.

14. The non-transitory recording medium storing a computer readable control program according to claim 10, wherein the image formation system further comprises a plurality of paper inserters each capable of supplying the partition paper sheet, and the control program causes the computer to execute a procedure of inserting the partition paper sheet on the paper ejection tray from the paper inserter positioned immediately upstream from the paper ejection tray in a paper conveyance direction among the plurality of paper inserters, by way of the paper conveyance passage.

15. The non-transitory recording medium storing a computer readable control program according to claim 10, wherein the image formation system further comprises at least one paper inserter capable of supplying the partition paper sheet, and the control program causes the computer to execute a procedure of inserting the partition paper sheet on the paper ejection tray from the paper inserter set in advance, by way of the paper conveyance passage.

16. The non-transitory recording medium storing a computer readable control program according to claim 10, wherein the image formation system further comprises a plurality of paper inserters each capable of supplying the partition paper sheet, and the control program causes the computer to execute a procedure of choosing the paper inserter to be used, on the basis of at least one of paper information on the paper sheet ejected to the paper ejection tray and paper information on the paper sheet remaining in the paper conveyance passage, as well as paper information on the paper sheets set in the plurality of paper inserters, and inserting the partition paper sheet on the paper ejection tray from the chosen paper inserter by way of the paper conveyance passage.

17. The non-transitory recording medium storing a computer readable control program according to claim 10, wherein the image formation system further comprises the plurality of post-processing devices, and the control program causes the computer to execute a procedure of, after the jam is detected, locating a paper sheet remaining in a conveyance route for the partition paper sheet extending from a position where the partition paper sheet is inserted into the paper conveyance passage to the paper ejection tray, which paper sheet is positioned upstream of the responsible paper sheet in a paper conveyance direction, and shifting the paper sheet to the paper conveyance passage in the post-processing device arranged upstream of a position of the responsible paper sheet but on a downstream side of a position of the paper sheet, to stop there.

18. The non-transitory recording medium storing a computer readable control program according to claim 10, wherein the control program causes the computer to execute a procedure of, after the jam is detected, moving a paper sheet being conveyed in the paper conveyance passage situated upstream of the paper sheet to be removed in a paper conveyance direction to a predetermined escape position available for purging, thereafter to stop there.

* * * * *